US011365535B2

(12) United States Patent
Kitaura et al.

(10) Patent No.: US 11,365,535 B2
(45) Date of Patent: Jun. 21, 2022

(54) FLUSH WATER TANK APPARATUS AND FLUSH TOILET APPARATUS PROVIDED WITH THE SAME

(71) Applicant: TOTO LTD., Kitakyushu (JP)

(72) Inventors: Hidekazu Kitaura, Kitakyushu (JP); Nobuhiro Hayashi, Kitakyushu (JP); Akihiro Shimuta, Kitakyushu (JP); Masahiro Kuroishi, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 0 days.

(21) Appl. No.: 17/212,279

(22) Filed: Mar. 25, 2021

(65) Prior Publication Data

US 2021/0270024 A1 Sep. 2, 2021

Related U.S. Application Data

(63) Continuation of application No. PCT/JP2021/004404, filed on Feb. 5, 2021.

(30) Foreign Application Priority Data

Feb. 28, 2020 (JP) ..... JP2020-033605
Feb. 28, 2020 (JP) ..... JP2020-033886
Jan. 22, 2021 (JP) ..... JP2021-008639

(51) Int. Cl.
*E03D 5/02* (2006.01)

(52) U.S. Cl.
CPC ..... *E03D 5/024* (2013.01)

(58) Field of Classification Search
CPC ..... E03D 5/024; E03D 5/022; E03D 5/02; E03D 5/10

(Continued)

(56) References Cited

U.S. PATENT DOCUMENTS 2,587,901 A * 3/1952 Robinson ..... E03D 1/302 4/398
4,809,367 A * 3/1989 Scott ..... E03D 1/144 4/324

(Continued)

FOREIGN PATENT DOCUMENTS

JP 2009-257061 A 11/2009

OTHER PUBLICATIONS

International Search Report issued in PCT/JP2021/004404; dated Apr. 20, 2021.

(Continued)

*Primary Examiner* — Huyen D Le
(74) *Attorney, Agent, or Firm* — Studebaker & Brackett PC

(57) ABSTRACT

A flush water tank apparatus enabling accurately setting an amount of flush water to be discharged while opening a discharge valve via a discharge valve hydraulic drive unit and a flush toilet apparatus including the flush water tank are provided. A flush water tank apparatus includes a first float device; a second float device that prevents from descent of the discharge valve according to the water level so as to discharge a second amount of flush water; and an adjustment mechanism configured so that when the second amount of flush water is selected by the flush water amount selection portion the clutch mechanism is disconnected at a pull-up height of the discharge valve such that the discharge valve descended by the disconnection of the clutch mechanism is held by the second float device in a holding state.

16 Claims, 12 Drawing Sheets

(58) Field of Classification Search
USPC ..... 4/394
See application file for complete search history.

(56) References Cited

U.S. PATENT DOCUMENTS 5,157,795 A * 10/1992 Pasquin ..... E03D 1/145
4/324
6,584,622 B1 * 7/2003 Nilsson ..... E03D 1/142
4/324

OTHER PUBLICATIONS

Written Opinion issued in PCT/JP2021/004404; dated Apr. 20, 2021.

* cited by examiner

FLUSH WATER TANK APPARATUS AND FLUSH TOILET APPARATUS PROVIDED WITH THE SAME

TECHNICAL FIELD

The present invention relates to a flush water tank apparatus and, in particular, to a flush water tank apparatus that supplies flush water to a flush toilet, and a flush toilet apparatus provided with the flush water tank apparatus.

BACKGROUND ART

In Japanese Patent Laid-Open No. 2009-257061, a low tank apparatus is described. In this low tank apparatus, a hydraulic cylinder device having a piston and a drain unit is arranged inside a low tank provided with a discharge valve, and the piston and the discharge valve are coupled via a coupling unit. At the time of discharging flush water in the low tank, water is supplied to the hydraulic cylinder device by opening a solenoid value, and the piston is pushed up. Since the piston is connected to the discharge valve via the coupling unit, the discharge valve is pulled up by movement of the piston, the discharge valve is opened, and the flush water in the low tank is discharged. The water supplied to the hydraulic cylinder device flows out from the drain unit and flows into the low tank.

Furthermore, in the case of causing the discharge valve to be closed, supply of water to the hydraulic cylinder device is stopped by causing the solenoid valve to be closed. Thereby, the pushed-up piston descends, and, accompanying this, the solenoid valve returns to a valve closed position due to its own weight. At this time, since the water in the hydraulic cylinder device flows out from the drain unit little by little, the piston slowly descends, and the discharge valve gradually returns to the valve closed position. Further, in the low tank apparatus described in Japanese Patent Laid-Open No. 2009-257061, a time during which the discharge valve is opened is changed by adjusting a time during which the solenoid valve is open, and, thereby, washings with different amounts of flush water, such as large washing and small washing, are realized.

SUMMARY OF INVENTION

Technical Problem

The low tank apparatus described in Japanese Patent Laid-Open No. 2009-257061, however, has a problem that it is difficult to accurately set the amount of flush water to be discharged. In other words, since water in the hydraulic cylinder device flows out from the drain unit little by little after the solenoid valve is closed to cause the discharge valve to be closed, in the low tank apparatus described in Japanese Patent Laid-Open No. 2009-257061, descent of the piston is gradual, and it is difficult to set the time during which the discharge valve is open short. Further, since the descent speed of the piston is dependent on the outflow rate of the water from the drain unit and sliding resistance of the piston, there is a possibility that variation occurs, and there is a possibility that change over time occurs. Therefore, it is difficult to accurately set the amount of flush water to be discharged, in the low tank apparatus described in Japanese Patent Laid-Open No. 2009-257061.

Therefore, an object of the present invention is to provide a flush water tank apparatus capable of accurately setting the amount of flush water to be discharged while having a configuration opening the discharge valve by using water pressure of supplied water, and a flush toilet apparatus provided with the flush water tank apparatus.

Solution to Problem

In order to solve the aforementioned problem, an embodiment of the present invention provides a flush water tank apparatus for supplying flush water to a flush toilet, the flush water tank apparatus including: a storage tank which stores flush water to be supplied to the flush toilet and in which a drain port for discharging the stored flush water to the flush toilet is formed; a discharge valve that opens and closes the drain port and that supplies flush water and stops the supply of flush water to the flush toilet; a discharge valve hydraulic drive unit that drives the discharge valve by using water supply pressure of supplied tap water; a clutch mechanism that couples the discharge valve and the discharge valve hydraulic drive unit to pull up the discharge valve by a driving force of the discharge valve hydraulic drive unit and that is disconnected at a predetermined pull-up height of the discharge valve to make the discharge valve descend; a flush water amount selection portion that enables selecting between a first amount of flush water for flushing the flush toilet and a second amount of flush water that is different from the first amount of flush water; a first float device that is moved according to a water level in the storage tank, the first float device being configured to be switched according to the water level from a holding state in which descent of the discharge valve is prevented to a non-holding state in which the descent is not prevented so as to discharge the first amount of flush water; a second float device that is moved according to the water level in the storage tank, the second float device being configured to be switched according to the water level from a holding state in which descent of the discharge valve is prevented to a non-holding state in which the descent is not prevented so as to discharge the second amount of flush water; and an adjustment mechanism that adjusts the pull-up height of the discharge valve at which the clutch mechanism is disconnected, the adjustment mechanism being configured so that when the second amount of flush water is selected by the flush water amount selection portion the clutch mechanism is disconnected at a pull-up height of the discharge valve such that the discharge valve descended by the disconnection of the clutch mechanism is held by the second float device in the holding state.

According to the embodiment of the present invention configured as above, the discharge valve and the discharge valve hydraulic drive unit are coupled by the clutch mechanism and decoupled with a predetermined pull-up height of the discharge valve, and thus, it is possible to, regardless of an operation speed of the discharge valve hydraulic drive unit, move the discharge valve and close the discharge valve. Thereby, it becomes possible to, even if the operation speed of the discharge valve hydraulic drive unit varies at the time of causing the discharge valve to descend, control the timing of causing the discharge valve to be closed without being influenced by the variation. Also, the adjustment mechanism is configured so that when the second amount of flush water is selected by the flush water amount selection portion the clutch mechanism is disconnected at a pull-up height of the discharge valve such that the discharge valve descended by the disconnection of the clutch mechanism is held by the second float device. Consequently, the second float device enables stable discharge of the second amount of flush water to the flush toilet. Therefore, the embodiment of the present invention enables setting the first and second amounts of flush water while using the clutch mechanism.

Advantageous Effects of Invention

According to the present invention, it is possible to provide a flush water tank apparatus capable of accurately setting the amount of flush water to be discharged while having a configuration opening a discharge valve by a discharge valve hydraulic drive unit, and a flush toilet apparatus provided with the flush water tank apparatus.

DESCRIPTION OF EMBODIMENTS

Next, a flush toilet apparatus according to a first embodiment will be described with reference to accompanying drawings.

Figure 1:
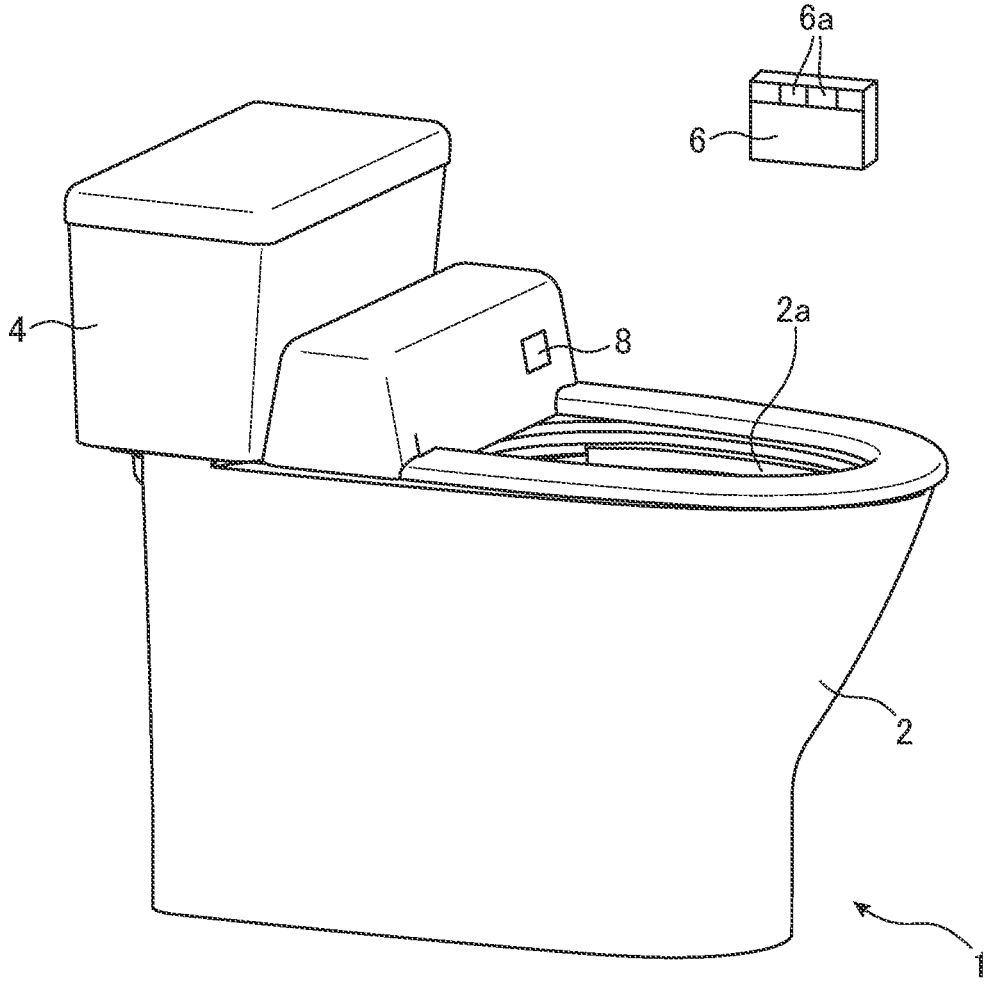
FIG. 1 is a perspective view showing an overall flush toilet apparatus provided with a flush water tank apparatus according to a first embodiment of the present invention.
Figure 2:
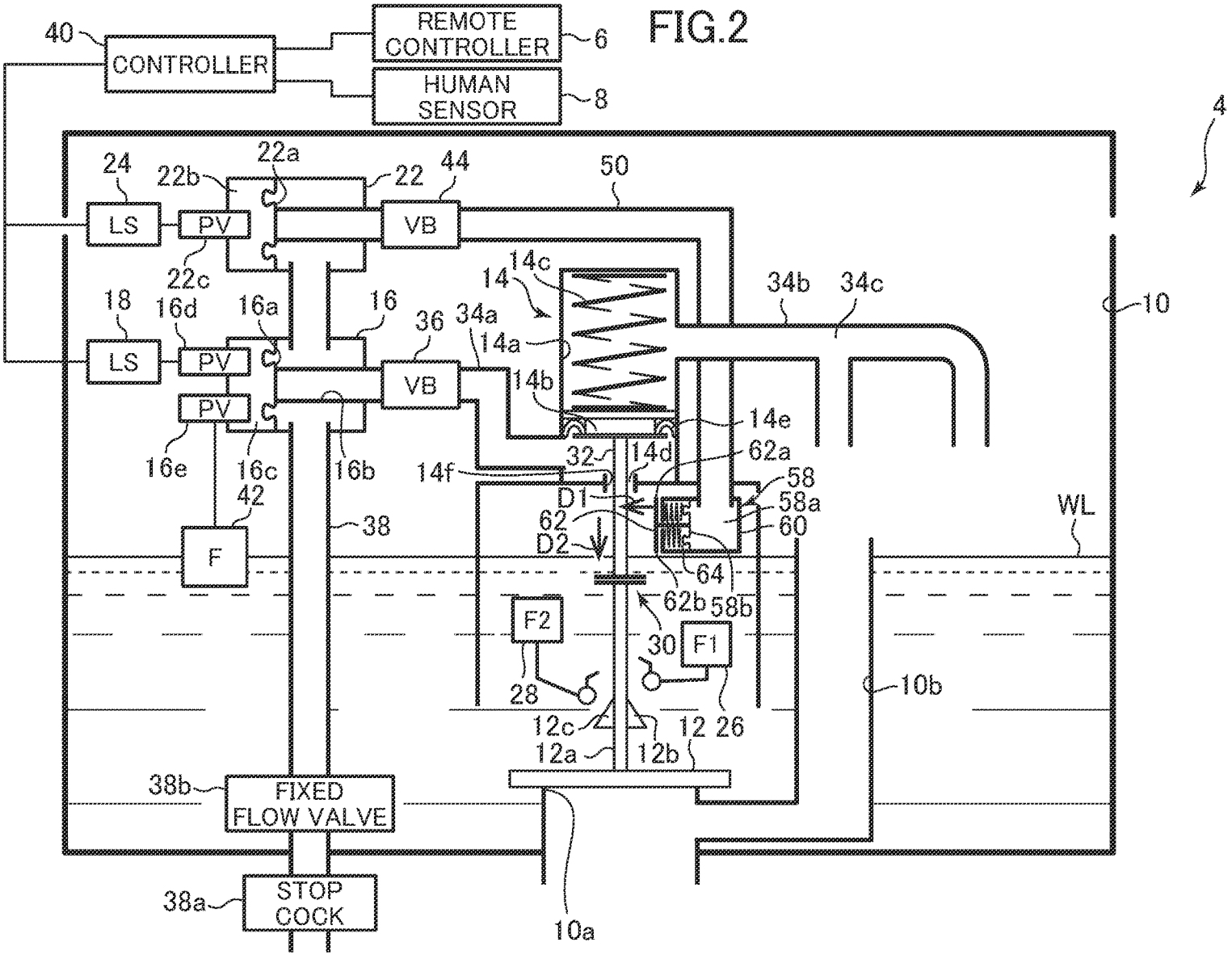
FIG. 2 is a sectional view showing a schematic configuration of the flush water tank apparatus according to the first embodiment of the present invention.

FIG. 1 is a perspective view showing an overall flush toilet apparatus provided with a flush water tank apparatus according to a first embodiment of the present invention. FIG. 2 is a sectional view showing a schematic configuration of the flush water tank apparatus according to the first embodiment of the present invention.

As shown in FIG. 1, a flush toilet apparatus 1 according to the first embodiment of the present invention is configured with a flush toilet main body 2, which is a flush toilet, and a flush water tank apparatus 4 according to the first embodiment of the present invention, which is placed at the back of the flush toilet main body 2. The flush toilet apparatus 1 of the present embodiment is configured so that washing of a bowl 2*a* of the flush toilet main body 2 is performed by a remote controller 6 attached to a wall surface being operated after use or by a predetermined time having passed after a human sensor 8 provided on a toilet seat detecting a user leaving the toilet seat. The flush water tank apparatus 4 according to the present embodiment is configured to discharge flush water stored inside to the flush toilet main body 2 based on an instruction signal from the remote controller 6 or the human sensor 8 and wash the bowl 2*a* by the flush water.

Further, "large washing" or "small washing" for washing the bowl 2*a* is executed by the user pressing a push button 6*a* on the remote controller 6. Therefore, in the present embodiment, the remote controller 6 functions as a flush water amount selection portion capable of selecting between a first amount of flush water for flushing the flush toilet main body 2 and a second amount of flush water that is different from the first amount of flush water. In the present embodiment, the second amount of flush water is smaller than the first amount of flush water. As a modification, the first amount of flush water may be smaller than the second amount of flush water. Note that, though the human sensor 8 is provided on the toilet seat in the present embodiment, the present invention is not limited to this form. The human sensor 8 is only required to be provided at a position where it is possible to detect the user's motions of sitting on, standing from, approach to and leaving from the toilet seat, and holding his hand. For example, the human sensor 8 may be provided on the flush toilet main body 2 or the flush water tank apparatus 4. Further, the human sensor 8 may be anything that can detect the user's motions of sitting on, standing from, approach to and leaving from the toilet seat, and holding his hand over it, and, for example, an infrared sensor or a microwave sensor can be used as the human sensor 8. Further, the remote controller 6 may be changed to an operation lever device or an operation button device having such a structure that is capable of mechanically controlling opening/closing of a first control valve 16 and a second control valve 22 described later.

As shown in FIG. 2, the flush water tank apparatus 4 supplies flush water to the flush toilet main body 2. The flush water tank apparatus 4 has a storage tank 10 for storing flush water to be supplied to the flush toilet main body 2, a discharge valve 12 for opening/closing a drain port 10*a* provided on the storage tank 10, and a discharge valve hydraulic drive unit 14 that drives the discharge valve 12. Also, the flush water tank apparatus 4 has the first control valve 16 that controls water supply into the discharge valve hydraulic drive unit 14 and the storage tank 10 and a solenoid valve 18 attached to the first control valve 16, inside the storage tank 10. Furthermore, the flush water tank apparatus 4 has the second control valve 22 for supplying flush water to a later-described adjustment mechanism and a solenoid valve 24 attached to the second control valve 22, inside the storage tank 10.

The flush water tank apparatus 4 further has a first float device 26, which is a timing control mechanism, for holding the pulled-up discharge valve 12 at a first position, and a second float device 28 for holding the discharge valve 12 at a second position that is lower than the first position. The flush water tank apparatus 4 further has a clutch mechanism 30 and the clutch mechanism 30 couples the discharge valve 12 and the discharge valve hydraulic drive unit 14 to pull up the discharge valve 12 via driving force of the discharge valve hydraulic drive unit 14.

The storage tank 10 is a tank configured to store flush water to be supplied to the flush toilet main body 2, and the drain port 10*a* for discharging the stored flush water to the flush toilet main body 2 is formed on a bottom portion of the storage tank 10. Inside the storage tank 10, an overflow pipe 10*b* is connected to the downstream side of the drain port 10*a*. The overflow pipe 10*b* vertically rises from near the drain port 10*a* and extends above a full water level WL of the flush water stored in the storage tank 10. Therefore, flush water that has flowed in from the upper end of the overflow pipe 10*b* bypasses the drain port 10*a* and flows out directly to the flush toilet main body 2.

The discharge valve 12 is a valve body arranged so as to open/close the drain port 10*a* and supplies flush water and stops the supply of flush water to the flush toilet main body 2. The discharge valve 12 is opened by being pulled upward, and flush water in the storage tank 10 is discharged to the flush toilet main body 2, so that the bowl 2*a* is washed. Also, the discharge valve 12 is pulled up by driving force of the discharge valve hydraulic drive unit 14, and when the discharge valve 12 is pulled up to a predetermined pull-up height, the clutch mechanism 30 is disconnected and the discharge valve 12 descends because of its own weight. When the discharge valve 12 descends, the discharge valve 12 is held for a predetermined time by the first float device 26 or the second float device 28, and a time until the discharge valve 12 is seated on the drain port 10*a* is thereby adjusted.

The discharge valve hydraulic drive unit 14 is configured to utilize water supply pressure of flush water supplied from a tap water pipe to drive the discharge valve 12. More specifically, the discharge valve hydraulic drive unit 14 has a cylinder 14*a* into which water supplied from the first control valve 16 flows, a piston 14*b* slidably arranged in the cylinder 14*a*, and a discharge valve driving rod 32 that projects from a lower end of cylinder 14*a* and that drives the discharge valve 12.

Furthermore, a spring 14*c* is arranged inside the cylinder 14*a* and energizes the piston 14*b* downward. A packing 14*e* is attached to the piston 14*b* so that watertightness between the inner wall surface of the cylinder 14*a* and the piston 14*b* is ensured. Furthermore, the clutch mechanism 30 is provided at a lower end of the discharge valve driving rod 32, and the discharge valve driving rod 32 and a valve stem 12*a* of the discharge valve 12 are coupled/decoupled by the clutch mechanism 30.

The cylinder 14*a* is a cylindrical-shaped member, which is arranged with its axis in the vertical direction and accepts the piston 14*b* inside in a slidable state. A drive unit water supply passage 34*a* is connected to a lower end portion of the cylinder 14*a* so that flush water flowing out of the first control valve 16 flows into the cylinder 14*a*. Therefore, the piston 14*b* in the cylinder 14*a* is pushed up against energizing force of the spring 14*c* by the flush water flowing into the cylinder 14*a*.

On an upper part of the cylinder 14*a*, an outflow hole is provided, and a drive unit discharge passage 34*b* communicates with the inside of the cylinder 14*a* via the outflow hole. Therefore, when flush water flows into the cylinder 14*a* from the drive unit water supply passage 34*a* connected to a lower part of the cylinder 14*a*, the piston 14*b* is pushed upward from the lower part of the cylinder 14*a* which is a first position. The piston 14*b* is driven by pressure of flush water flowing into the cylinder 14*a*. Then, when the piston 14*b* is pushed up to a second position above the outflow hole, the water that flowed into the cylinder 14*a* flows through the drive unit discharge passage 34*b* from the outflow hole. In other words, when the piston 14*b* is moved to the second position, the drive unit water supply passage 34*a* and the drive unit discharge passage 34*b* are caused to communicate with each other via the inside of the cylinder 14*a*. The drive unit discharge passage 34*b* is configured to make water flow into the storage tank 10 and also make water flow into the overflow pipe 10*b*. Therefore, a part of flush water supplied from the first control valve 16 is discharged to the flush toilet main body 2 through the overflow pipe 10*b* and the remainder is stored in the storage tank 10.

The discharge valve driving rod 32 is a rod-shaped member connected to a lower surface of the piston 14*b* and extends in such a manner as to project downward from the inside of the cylinder 14*a* through a through-hole 14*f* formed in a bottom surface of the cylinder 14*a*. The discharge valve driving rod 32 is connected to the piston 14*b* and drives the discharge valve 12. Also, between the discharge valve driving rod 32 projecting downward from the cylinder 14*a* and an inner wall of the through-hole 14*f* of the cylinder 14*a*, a gap 14*d* is provided, and a part of flush water flowing into the cylinder 14*a* flows out from the gap 14*d*. The water flowing out from the gap 14*d* flows into the storage tank 10. Note that, since the gap 14*d* is relatively narrow, and flow channel resistance is large, pressure inside the cylinder 14*a* increases due to the flush water flowing into the cylinder 14*a* from the drive unit water supply passage 34*a* even in the state of water flowing out from the gap 14*d*, and the piston 14*b* is pushed up, being against the energizing force of the spring 14*c*.

Next, the first control valve 16 is configured to control supply of water to the discharge valve hydraulic drive unit 14 based on operation of the solenoid valve 18 and control to supply flush water/stop the supply of flush water to the storage tank 10 via the drive unit discharge passage 34*b*. In other words, the first control valve 16 is provided with a main valve body 16*a*, a main valve port 16*b* that is opened/closed by the main valve body 16*a*, a pressure chamber 16*c* for making the main valve body 16*a* move, a pilot valve 16*d* for switching pressure in the pressure chamber 16*c*, and a pilot valve 16*e*.

The main valve body 16*a* is configured so as to open/close the main valve port 16*b* of the first control valve 16. When the main valve port 16*b* is opened, tap water supplied from a water supply pipe 38 flows into the discharge valve hydraulic drive unit 14. The pressure chamber 16*c* is provided adjacent to the main valve body 16*a* in a case of the first control valve 16. The pressure chamber 16*c* is configured so that a part of the tap water supplied from the water supply pipe 38 flows in so that internal pressure increases. When the pressure in the pressure chamber 16*c* increases, the main valve body 16*a* is moved toward the main valve port 16*b*, and the main valve port 16*b* is closed.

The pilot valve 16*d* and the pilot valve 16*e* are each configured to open/close a pilot valve port (not shown) provided in the pressure chamber 16*c*. When the pilot valve port (not shown) is opened by the pilot valve 16*d*, water in the pressure chamber 16*c* flows out, and the internal pressure decreases. When the pressure in the pressure chamber 16*c* decreases, the main valve body 16*a* leaves from the main valve port 16*b*, and the first control valve 16 is opened. Also, when the pilot valve 16*d* and the pilot valve 16*e* are both closed, the pressure in the pressure chamber 16*c* increases and the first control valve 16 is thereby closed.

The pilot valve 16*d* is moved by the solenoid valve 18 attached to the pilot valve 16*d* to open/close the pilot valve port (not shown). The solenoid valve 18 is electrically connected to a controller 40 and causes the pilot valve 16*d* to move, based on a command signal from the controller 40. Specifically, the controller 40 receives a signal from the remote controller 6 or the human sensor 8 and sends an electrical signal to the solenoid valve 18 to cause the solenoid valve 18 to operate.

On the other hand, a float switch 42 is connected to the pilot valve 16*e*. The float switch 42 is configured to control the pilot valve 16*e* based on a water level of water in the storage tank 10 to open/close the relevant pilot valve port (not shown). In other words, when the water level in the storage tank 10 reaches a predetermined water level, the float switch 42 transmits a signal to the pilot valve 16*e* to close the pilot valve port (not shown). In other words, the float switch 42 is configured to set the water storage level in the storage tank 10 to the predetermined full water level WL which is a stopped water level. The float switch 42 is arranged in the storage tank 10 and is configured to, when the water level of the storage tank 10 increases to the full water level WL, stop water supply from the first control valve 16 to the discharge valve hydraulic drive unit 14. Note that the float switch 42 can be replaced with a ball tap mechanism. The ball tap mechanism is provided with a ball tap float that moves up/down according to a water level and a support arm that is connected to the ball tap float and that acts on the pilot valve 16*e*. Consequently, in the ball tap mechanism, when the water level in the storage tank 10 rises to the full water level WL, the ball tap float also rises and the support arm connected to the ball tap float is rotated upward, thereby the pilot valve port (not shown) of the pilot valve 16*e* being mechanically closed. In the ball tap mechanism, when the water level in the storage tank 10 drops below the full water level WL, the ball tap float also descends and the support arm connected to the ball tap float is rotated downward, thereby the pilot valve port (not shown) of the pilot valve 16*e* is mechanically opened.

Further, the drive unit water supply passage 34*a* between the first control valve 16 and the discharge valve hydraulic drive unit 14 is provided with a vacuum breaker 36. When negative pressure occurs on the first control valve 16 side, backflow of water to the first control valve 16 side is prevented by the vacuum breaker 36.

The second control valve 22 is configured to control supply of flush water/stop the supply of flush water to a later-described adjustment mechanism 58 based on operation of the solenoid valve 24. Though the second control valve 22 is connected to the water supply pipe 38 via the first control valve 16, tap water supplied from the water supply pipe 38 always flows into the second control valve 22 irrespective of whether the first control valve 16 is open or closed. The second control valve 22 is provided with a main valve body 22*a*, a pressure chamber 22*b* and a pilot valve 22*c*. The pilot valve 22*c* is opened/closed by the solenoid valve 24. When the pilot valve 22*c* is opened by the solenoid valve 24, the main valve body 22*a* of the second control valve 22 is opened, and tap water flowing in from the water supply pipe 38 is supplied to the adjustment mechanism 58. Further, the solenoid valve 24 is electrically connected to the controller 40 and causes the pilot valve 22*c* to move, based on a command signal from the controller 40. Specifically the controller 40 sends an electrical signal to the solenoid valve 24 based on an operation of the remote controller 6 to cause the solenoid valve 24 to operate.

Further, the water supply passage 50 is provided with a vacuum breaker 44. When negative pressure occurs on the second control valve 22 side, backflow of water to the second control valve 22 side is prevented by the vacuum breaker 44. A cylinder portion 60 is connected to the water supply passage 50 extending from the second control valve 22.

Water supplied from the tap water pipe is supplied to each of the first control valve 16 and the second control valve 22 via a stop cock 38*a* arranged outside the storage tank 10 and a fixed flow valve 38*b* arranged in the storage tank 10 on the downstream side of the stop cock 38*a*. The stop cock 38*a* is provided to stop supply of water to the flush water tank apparatus 4 at the time of maintenance and the like, and is usually used in an open state. The fixed flow valve 38*b* is provided so as to cause water supplied from the tap water pipe to flow into the first control valve 16 and the second control valve 22 at a predetermined flow rate, and is configured so that water at a certain flow rate is supplied regardless of the installation environment of the flush toilet apparatus 1.

The controller 40 includes a CPU, a memory and the like and controls connected equipment to execute a large washing mode and/or a small washing mode described later, based on a predetermined control program recorded in the memory or the like. The controller 40 is electrically connected to the remote controller 6, the human sensor 8, the solenoid valve 18, the solenoid valve 24 and the like.

Next, a configuration and operation of the clutch mechanism 30 will be described, newly referring to FIG. 3A to FIG. 3H.

FIG. 3A to FIG. 3H schematically show the configuration of the clutch mechanism 30 and shows operation at the time of being pulled up by the discharge valve hydraulic drive unit 14.

Figure 3A:
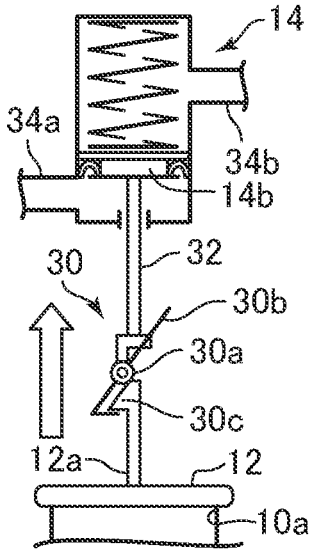
FIG. 3A is a diagram schematically showing a configuration and operation of a clutch mechanism provided in the flush water tank apparatus according to the first embodiment of the present invention.

First, as shown in FIG. 3A, the clutch mechanism 30 is provided at the lower end of the discharge valve driving rod 32 extending downward from the discharge valve hydraulic drive unit 14 and is configured to couple/decouple the lower end of the discharge valve driving rod 32 and an upper end of the valve stem 12*a* of the discharge valve 12. The clutch mechanism 30 has a rotary shaft 30*a* attached to the lower end of the discharge valve driving rod 32, a hook member 30*b* supported by the rotary shaft 30*a* and an engaging claw 30*c* provided at the upper end of the valve stem 12*a*. Because of such structure as above, the clutch mechanism 30 is disconnected at a predetermined timing and a predetermined pull-up height to make the discharge valve 12 descend. The hook member 30*b* functions as an engaging member of the clutch mechanism 30.

The rotary shaft 30*a* is attached to the lower end of the discharge valve driving rod 32 in such a manner as to extend horizontally and rotatably supports the hook member 30*b*. The hook member 30*b* is a plate-shaped member, and an intermediate part of the hook member 30*b* is rotatably supported by the rotary shaft 30*a*. The lower end of the hook member 30*b* is bent in a hook shape to form a hook portion. The engaging claw 30*c* provided on the upper end of the valve stem 12*a* of the discharge valve 12 is a claw in a right-angle triangular shape. The base of the engaging claw 30*c* is almost in the horizontal direction, and the side face is formed to be sloped downward.

In the state shown in FIG. 3A, the discharge valve 12 seats on the drain port 10*a*, and the drain port 10*a* is closed. In this state, the discharge valve hydraulic drive unit 14 and the discharge valve 12 are coupled. In this coupled state, the hook portion of the hook member 30*b* engages with the base of the engaging claw 30*c*, enabling the discharge valve 12 to be pulled up by the discharge valve driving rod 32.

Figure 3B:
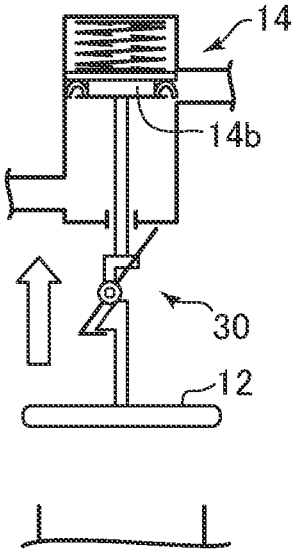
FIG. 3B is a diagram schematically showing a configuration and operation of a clutch mechanism provided in the flush water tank apparatus according to the first embodiment of the present invention.
Figure 3C:
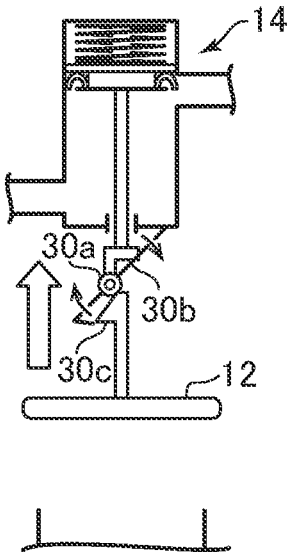
FIG. 3C is a diagram schematically showing a configuration and operation of a clutch mechanism provided in the flush water tank apparatus according to the first embodiment of the present invention.
Figure 3D:
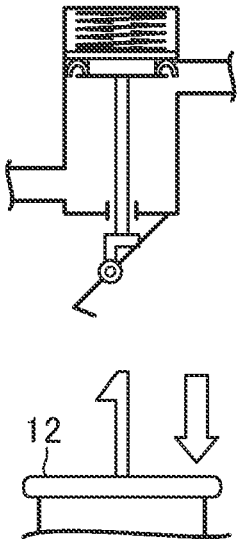
FIG. 3D is a diagram schematically showing a configuration and operation of a clutch mechanism provided in the flush water tank apparatus according to the first embodiment of the present invention.

Next, as shown in FIG. 3B, when flush water is supplied to the discharge valve hydraulic drive unit 14, the piston 14*b* moves upward, and accordingly, the discharge valve 12 is pulled up by the discharge valve driving rod 32. Furthermore, as shown in FIG. 3C, when the discharge valve 12 is pulled up to a predetermined position, the upper end of the hook member 30*b* comes into contact with the bottom surface of the discharge valve hydraulic drive unit 14, and the hook member 30*b* is rotated around the rotary shaft 30*a*. By this rotation, the claw portion at the lower end of the hook member 30*b* is moved in a direction of disengaging from the engaging claw 30*c*, and engagement between the hook member 30*b* and the engaging claw 30*c* is released. When the engagement between the hook member 30*b* and the engaging claw 30*c* is released, the discharge valve 12 descends toward the drain port 10*a* in flush water stored in the storage tank 10 as shown in FIG. 3D. (Note that, as described later, the descended discharge valve 12 is temporarily held at a predetermined height by a first holding mechanism 46 before being seated on the drain port 10*a*.)

Figure 3E:
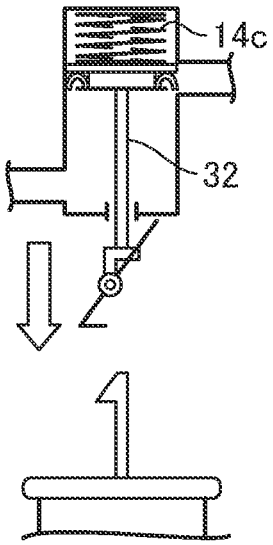
FIG. 3E is a diagram schematically showing a configuration and operation of a clutch mechanism provided in the flush water tank apparatus according to the first embodiment of the present invention.
Figure 3F:
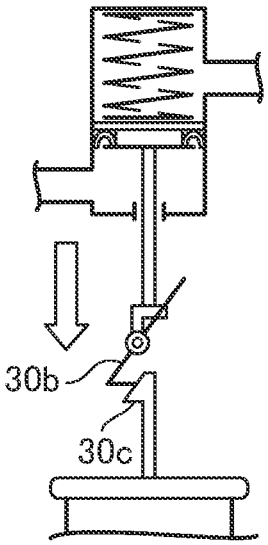
FIG. 3F is a diagram schematically showing a configuration and operation of a clutch mechanism provided in the flush water tank apparatus according to the first embodiment of the present invention.
Figure 3G:
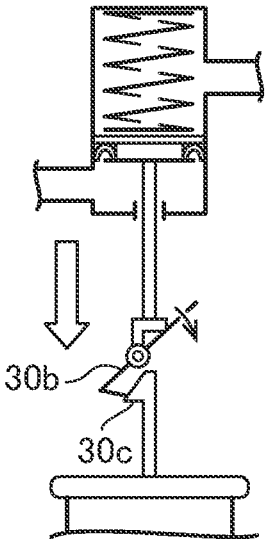
FIG. 3G is a diagram schematically showing a configuration and operation of a clutch mechanism provided in the flush water tank apparatus according to the first embodiment of the present invention.
Figure 3H:
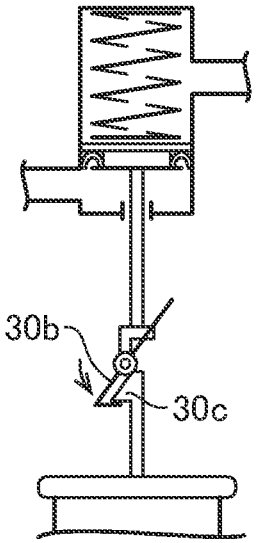
FIG. 3H is a diagram schematically showing a configuration and operation of a clutch mechanism provided in the flush water tank apparatus according to the first embodiment of the present invention.

Furthermore, as shown in FIG. 3E, when flush water supplied to the discharge valve hydraulic drive unit 14 is stopped, the discharge valve driving rod 32 descends because of the energizing force of the spring 14*c*. When the discharge valve driving rod 32 descends, as shown in FIG. 3F, a distal end of the hook portion of the hook member 30*b* attached to the lower end of the discharge valve driving rod 32 comes into contact with the engaging claw 30*c*. When the discharge valve driving rod 32 descends more, as shown in FIG. 3G, the hook portion of the hook member 30*b* is pushed by the sloped surface of the engaging claw 30*c* and the hook member 30*b* is thereby rotated. When the discharge valve driving rod 32 descends more, as shown in FIG. 3H, the hook portion of the hook member 30*b* climbs over the engaging claw 30*c*, the hook member 30*b* is rotated to the original position by the gravity and the hook portion of the hook member 30*b* and the engaging claw 30*c* engage with each other again and thus returns to the state shown in FIG. 3A.

Referring back to FIGS. 2 and 4 again, the first float device 26, the second float device 28, etc., of the flush water tank apparatus 4 will be described.

Figure 4A:
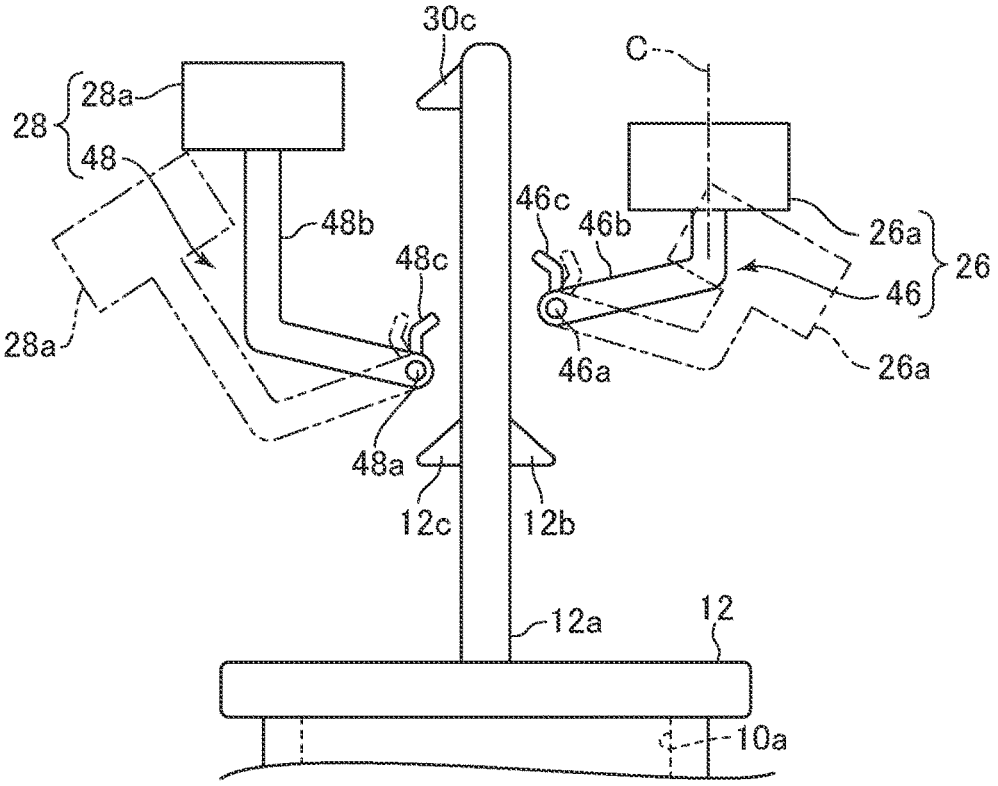
FIG. 4A is enlarged views each showing a discharge valve, a first float device and a second float device included in the flush water tank apparatus according to the first embodiment of the present invention.
Figure 4B:
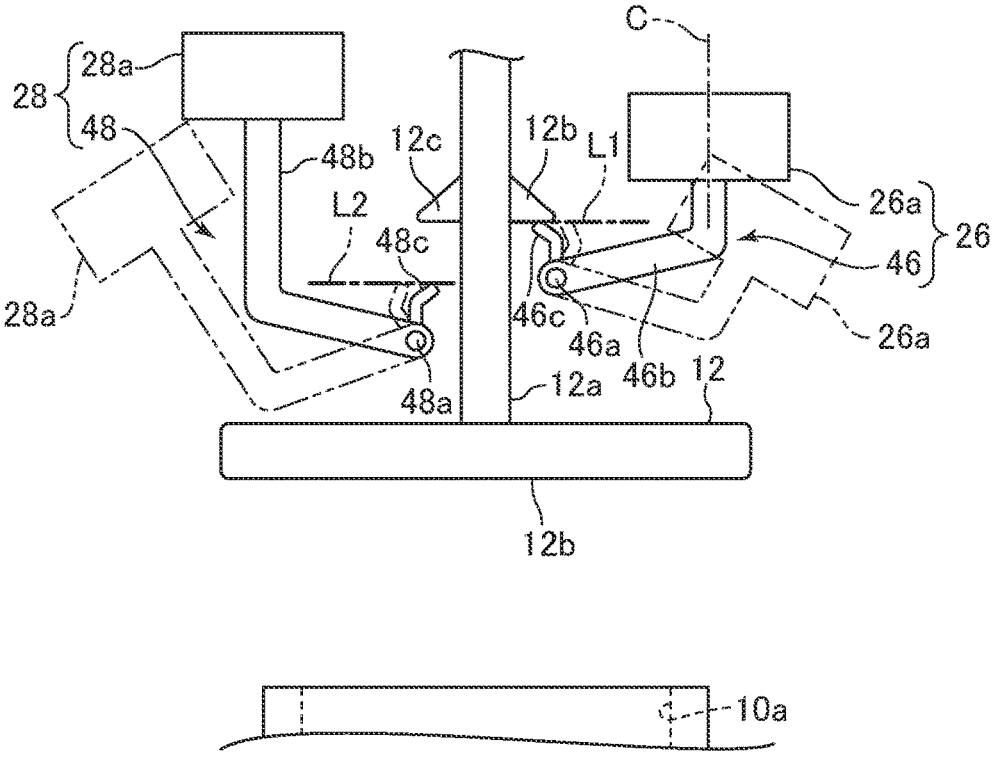
FIG. 4B is enlarged views each showing a discharge valve, a first float device and a second float device included in the flush water tank apparatus according to the first embodiment of the present invention.

FIGS. 4A and 4B are enlarged views each showing the part of the discharge valve 12, the first float device 26 and the second float device 28 in FIG. 2. A state in which the discharge valve 12 is closed is shown in FIG. 4A, and a state in which the discharge valve 12 is open and held by the first float device 26 is shown in FIG. 4B.

As shown in FIGS. 4A and 4B, the first float device 26 is moved according to the water level in the storage tank 10. The first float device 26 is configured to be switched according to the water level from a holding state in which descent of the discharge valve 12 is prevented to a non-holding state in which the descent is not prevented, according to the water level in the storage tank 10 so as to discharge the first amount of flush water. The first float device 26 has a first float 26*a* and the first holding mechanism 46 rotatably supporting the first float 26*a*.

The first float 26*a* is a hollow rectangular parallelepiped member and is configured to receive buoyancy from flush water stored in the storage tank 10. When the water level in the storage tank 10 is a predetermined water level or above, the first float 26*a* is in the state shown by solid lines in FIG. 4A due to the buoyancy.

The first holding mechanism 46 is a mechanism that rotatably supports the first float 26*a*, and has a support shaft 46*a*, and an arm member 46*b* and an engaging member 46*c* supported by the support shaft 46*a*. The support shaft 46*a* is a rotary shaft fixed to the storage tank 10 by an arbitrary member (not shown) and supports the arm member 46*b* and the engaging member 46*c* in a rotatable state. At a proximal end portion of the valve stem 12*a* of the discharge valve 12, a holding claw 12*b* formed to be engageable with the engaging member 46*c* is formed. The holding claw 12*b* is a projection in a right-angle triangular shape, which extends toward the engaging member 46*c* from the proximal end portion of the valve stem 12*a*. Its base is in the horizontal direction, and its side face is formed to be sloped downward.

The support shaft 46*a* is a shaft extending in a direction orthogonal to the surface of FIGS. 4A and 4B. Both of its end portions are fixed to the storage tank 10 by an arbitrary member (not shown), and an intermediate part is formed being curved to be away from the valve stem 12*a*. The arm member 46*b* is a beam-shaped member that is bent, and its lower end portion is configured to branch into two. These branched lower ends of the arm member 46*b* are rotatably supported by both end portions of the support shaft 46*a*, respectively. Therefore, even when the discharge valve 12 is moved in the vertical direction, it does not happen that the support shaft 46*a* and the arm member 46*b* interfere with the holding claw 12*b* provided on the valve stem 12*a* of the discharge valve 12.

An upper end portion of the arm member 46*b* is fixed to the bottom surface of the first float 26*a*. Therefore, in a state of receiving buoyancy, the first float 26*a* is held in the state shown by the solid lines in FIG. 4A. When the water level in the storage tank 10 drops, the first float 26*a* and the arm member 46*b* are rotated around the support shaft 46*a* due to their own weights up to a state shown by imaginary lines in FIG. 4A. Note that the rotation of the first float 26*a* and the arm member 46*b* is restricted to a range between the holding state of the first holding mechanism 46 shown by the solid lines in FIG. 4A and the non-holding state shown by the imaginary lines.

Furthermore, the engaging member 46*c* is a member rotatably attached to the support shaft 46*a*, and its proximal end portion is rotatably supported by both end portions of the support shaft 46*a*. A distal end portion of the engaging member 46*c* curvedly extends towards the valve stem 12*a* of the discharge valve 12. Therefore, in the holding state of having been rotated to the position shown by the solid lines of FIG. 4A, the distal end portion of the engaging member 46*c* interferes with the holding claw 12*b* provided on the valve stem 12*a*. In comparison, in the non-holding state of having been rotated to the position shown by the imaginary lines of FIG. 4A, interference between the distal end portion of the engaging member 46*c* and the holding claw 12*b* does not occur.

The engaging member 46*c* is configured to be rotated around the support shaft 46*a* in conjunction with the arm member 46*b*. In other words, when the first float 26*a* and the arm member 46*b* are rotated from the state shown by the solid lines in FIG. 4A to the state shown by the imaginary lines, the engaging member 46*c* is also rotated to the state shown by the imaginary lines in conjunction with the arm member 46*b*. However, if the distal end of the engaging member 46*c* is pushed upward by the holding claw 12*b* of the discharge valve 12 in the state shown by the solid lines in FIG. 4A, only the engaging member 46*c* can rotate idle. In other words, when the distal end portion of the engaging member 46*c* is pushed upward by the holding claw 12*b*, only the engaging member 46*c* can rotate to the position shown by the imaginary lines of FIGS. 4A and 4B while the first float 26*a* and the arm member 46*b* keep holding the position shown by the solid lines.

In a state in which the discharge valve 12 is pulled upward, and the holding claw 12*b* is positioned above the engaging member 46*c* as shown by solid lines in FIG. 4B, the holding claw 12*b* and the engaging member 46*c* engage with each other, and descent of the discharge valve 12 is prevented. In other words, the engaging member 46*c* constituting the first holding mechanism 46 engages with the discharge valve 12 and holds the discharge valve 12 at a predetermined height. Therefore, the discharge valve 12 is pulled up by the discharge valve driving rod 32 (FIG. 3A to FIG. 3H) connected to the discharge valve hydraulic drive unit 14, and subsequently, when the clutch mechanism 30 is disconnected, the discharge valve 12 descends. The holding claw 12*b* of the discharge valve 12 and the engaging member 46*c* of the first holding mechanism 46 engage with each other during the descent, and the discharge valve 12 is held at the predetermined height. A height position at which the holding claw 12*b* and the engaging member 46*c* engage with each other is a first height position L1.

Subsequently when the water level in the storage tank 10 drops, the position of the first float 26*a* descends, and the first float 26*a* and the arm member 46*b* rotate to the position indicated by imaginary lines in FIG. 4B (as described later, in this state, the second float device 28 is also rotated to the position indicated by imaginary lines). Since the engaging member 46*c* is also rotated to the position shown by the imaginary lines in FIG. 4B in conjunction with this rotation, the engagement between the holding claw 12*b* and the engaging member 46*c* is released. Thereby, the discharge valve 12 descends and seats on the drain port 10*a*, and the drain port 10*a* is closed.

Next, the second float device 28 will be described with reference to FIGS. 4A and 4B.

The second float device 28 is moved according to the water level in the storage tank 10. The second float device 28 is configured to be switched from a holding state in which descent of the discharge valve 12 is prevented to a non-holding state in which the descent is not prevented, according to the water level in the storage tank 10 so as to discharge the second amount of flush water. The second float device 28 has a second float 28*a* and a second holding mechanism 48 that rotatably supports the second float 28*a*. The second float device 28 is arranged on the opposite side of the valve stem 12*a* of the discharge valve 12 from the first float device 26.

The second float 28*a* is a hollow rectangular parallelepiped member and is configured to receive buoyancy from flush water stored in the storage tank 10. When the water level in the storage tank 10 is a predetermined water level or above, the second float 28*a* is in the holding state indicated by solid lines in FIG. 4A because of the buoyancy.

The second holding mechanism 48 is a mechanism that rotatably supports the second float 28*a*, and has a support shaft 48*a*, and an arm member 48*b* and an engaging member 48*c* supported by the support shaft 48*a*. The configuration and operation of the second holding mechanism 48 are similar to those of the first holding mechanism 46; however, the engaging member 48*c* included in the second holding mechanism 48 is arranged in such a manner as to engage with a holding claw 12*c* provided on the valve stem 12*a* of the discharge valve 12. Like the holding claw 12*b* with which the engaging member 46*c* of the first holding mechanism 46 engages, the holding claw 12*c* is also a projection in a right-angle triangular shape, and is formed at a height that is the same as that of the holding claw 12*b* on the valve stem 12*a* of the discharge valve 12. The holding claw 12*b* and the holding claw 12*c* are formed bilaterally symmetrical with respect to the valve stem 12*a*. Note that the holding claw 12*c* may be formed by the holding claw 12*b* being formed annularly around the valve stem 12*a*. A height position at which the holding claw 12*c* and the engaging member 48*c* engage with each other is a second height position L2. The first height position L1 at which the first float device 26 engages with the discharge valve 12 in the holding state is higher than the second height position L2 at which the second float device 28 in the holding state engages with the discharge valve 12.

Also, the support shaft 48*a* of the second holding mechanism 48 is arranged at a position that is lower than that of the support shaft 46*a* of the first holding mechanism 46. Therefore, when the discharge valve 12 is held by the second holding mechanism 48, the discharge valve 12 is held at a position that is lower than that of when the discharge valve 12 is held by the first holding mechanism 46. Furthermore, since the arm member 48*b* of the second holding mechanism 48 is longer than the arm member 46*b* of the first holding mechanism 46, the second float 28*a* is supported at a position that is higher than the first float 26*a*. Consequently, when the water level in the storage tank 10 drops, the second float 28*a* is rotated to the position in the non-holding position indicated by imaginary lines in FIGS. 4A and 4B ahead of the first float 26*a*.

Next, the adjustment mechanism of the flush water tank apparatus will be described with reference to FIG. 2.

The flush water tank apparatus 4 further has the adjustment mechanism 58, which is a valve control hydraulic drive unit that adjusts the pull-up height of the discharge valve 12 with which the clutch mechanism 30 is disconnected.

The adjustment mechanism 58 is configured so that when the second amount of flush water is selected by the remote controller 6, the clutch mechanism 30 is disconnected at a pull-up height of the discharge valve 12, the pull-up height allowing the discharge valve 12 descending by the disconnection of the clutch mechanism 30 is held by the second float device 28 in the holding state. The adjustment mechanism 58 is configured so that when the second amount of flush water is selected by the remote controller 6, the clutch mechanism 30 is disconnected when the holding claw 12*b* and the holding claw 12*c* of the discharge valve 12, which are respective engaging portions for the first float device 26 and the second float device 28, are located at a height position between the first height position L1 and the second height position L2.

The adjustment mechanism 58 is provided with the cylinder portion 60 forming a cylindrical-shaped cylinder for forming a piston cylinder, a pressure chamber 58*a* into which water supplied from the water supply passage 50 flows, an elastic film 58*b*, which is a drive portion to be driven by water supply pressure of water flowing into the pressure chamber 58*a*, a rod member 62 that is driven by the elastic film 58*b* to make operational force act on the clutch mechanism 30, and a spring 64 that is arranged inside the cylinder portion 60 and that energizes the rod member 62 into a standby state via repulsive force.

The cylinder portion 60 is connected to the water supply passage 50 and is formed in such a manner as to be capable of storing flush water therein. The cylinder portion 60 is arranged at a position that is slightly lower than the bottom surface of the discharge valve hydraulic drive unit 14.

A volume of the pressure chamber 58*a* is smaller volume than a volume of the cylinder 14*a* of the discharge valve hydraulic drive unit 14. Consequently, the rod member 62 can be driven merely by a small amount of tap water being supplied to the pressure chamber 58*a*, enabling enhancement in responsiveness of the adjustment mechanism 58.

Also, an outflow hole (not shown) is provided in a lower end portion of the pressure chamber 58*a*, and water flowing into the pressure chamber 58*a* flows out to the storage tank 10 from the outflow hole. Since this outflow hole is relatively narrow and thus provides large flow channel resistance, even if water flows out from the outflow hole, pressure inside the pressure chamber 58*a* is increased by water flowing in from the second control valve 22.

The elastic film 58*b* is formed by, e.g., a diaphragm and is configured to drive the rod member 62 by elastically deforming based on the water supply pressure of water flowing into the pressure chamber 58*a*. Consequently, in comparison with a case where the rod member 62 is driven by a piston being slid inside the pressure chamber 58*a*, there is no need to provide a slide seal for a piston, enabling elimination of sliding resistance of a piston.

A proximal end of the rod member 62 is connected to the elastic film 58*b*. A distal end of the rod member 62 extends horizontally toward the clutch mechanism 30 and is pushed and thus moved by flush water supplied and stored in the cylinder portion 60. The rod member 62 is a rod-equipped rigid member. The rod member 62 is formed in such a manner as to move horizontally toward the discharge valve driving rod 32 on the lower side relative to the bottom surface of the discharge valve hydraulic drive unit 14. The distal end of the rod member 62 is formed in a T-shape and an upper end 62*a* of the T-shape is arranged in the vicinity of the bottom surface of the discharge valve hydraulic drive unit 14. Also, the rod member 62 has the proximal end attached to the elastic film 58*b* and projects horizontally toward the clutch mechanism 30 from a housing forming the pressure chamber 58*a*; however, there is no need to provide a shaft seal between the housing forming the pressure chamber 58*a* and a shaft rod of the rod member 62. Consequently, it is possible to eliminate sliding resistance due to a shaft seal between the housing of the pressure chamber 58*a* and the rod member 62.

As a result of the elastic film 58*b* deforming because of an increase in pressure inside the pressure chamber 58*a*, the rod member 62 projects toward the clutch mechanism 30. Then, when the inflow of water from the second control valve 22 ceases, the pressure inside the pressure chamber 58*a* is decreased by an outflow of water from the outflow hole. The decrease in pressure inside the pressure chamber 58*a* makes the deformed elastic film 58*b* return to its original shape, and the rod member 62 moves toward the pressure chamber 58*a*. Then, as described later, engagement between the valve stem 12*a* of the discharge valve 12 and the discharge valve driving rod 32 via the clutch mechanism 30 is released at the early timing by making the rod member 62 project toward the clutch mechanism 30, which is a discharge valve holding mechanism. Also, the horizontal direction in which the rod member 62 projects intersects with the vertical direction in which the discharge valve 12 is pulled up. Consequently engagement between the discharge valve driving rod 32 and the valve stem 12*a* of the discharge valve 12 via the clutch mechanism 30 can reliably be released.

More specifically, the clutch mechanism 30 can be disconnected at the early timing by the upper end of the hook member 30*b* of the clutch mechanism 30 hitting a lower end 62*b* of the T-shape and the T-shape part is formed in a flat plate-like shape extending vertically. When the clutch mechanism 30 hits the lower end 62*b*, the upper end 62*a* comes into contact with the bottom surface of the discharge valve hydraulic drive unit 14. Therefore, when the clutch mechanism 30 hits the lower end 62*b*, the rod member 62 can stably disconnect the clutch mechanism 30. Also, a moving direction D1 in which the rod member 62 moves and a parting direction D2 in which the clutch mechanism 30 is disconnected and moves away are different from each other and form an angle of substantially 90 degrees.

The spring 64 is arranged on the discharge valve stem side inside the cylinder portion 60 and moves the rod member 62 to the cylinder portion 60 side (retracts the rod member 62 to the cylinder portion 60 side) upon a decrease in supply of flush water into the cylinder portion 60.

Next, a description will be made on operation of the flush water tank apparatus 4 according to the first embodiment of the present invention and operation of the flush toilet apparatus 1 provided with the flush water tank apparatus 4, newly referring to FIG. 2 and FIGS. 5 to 10.

First, in the toilet washing standby state shown in FIG. 2, the water level in the storage tank 10 is the predetermined full water level WL. In this state, both of the first control valve 16 and the second control valve 22 are closed. Each of the first holding mechanism 46 and the second holding mechanism 48 is in the holding state indicated by the solid lines by FIG. 4A. Next, when the user pushes a large washing button on the remote controller 6 (FIG. 1), the remote controller 6 transmits an instruction signal for executing the large washing mode to the controller 40 (FIG. 2). When a small washing button is pushed, an instruction signal for executing the small washing mode is transmitted to the controller 40. Thus, in the present embodiment, the flush toilet apparatus 1 is provided with the two washing modes, the large washing mode and the small washing mode with different amounts of flush water, and the remote controller 6 functions as the flush water amount selection portion for selecting the amount of flush water.

Note that, in the flush toilet apparatus 1 of the present embodiment, if a predetermined time passes without the washing button on the remote controller 6 not being pressed after it is detected by the human sensor 8 (FIG. 1) that the user has left the toilet seat, an instruction signal for toilet washing is also transmitted to the controller 40. Further, if a time from the user sitting on the toilet seat until leaving the toilet seat is shorter than a predetermined time, the controller 40 judges that the user has urinated and executes the small washing mode. On the other hand, if the time from sitting on the toilet seat until leaving the toilet seat is longer than the predetermined time, the controller 40 executes the large washing mode. Therefore, in this case, since the large washing mode for performing washing with the first amount of flush water or the small washing mode for performing washing with the second amount of flush water is selected by the controller 40, the controller 40 functions as the flush water amount selection portion.

Next, operation of the large washing mode will be described with reference to FIG. 2, and FIGS. 5 to 10.

Figure 5:
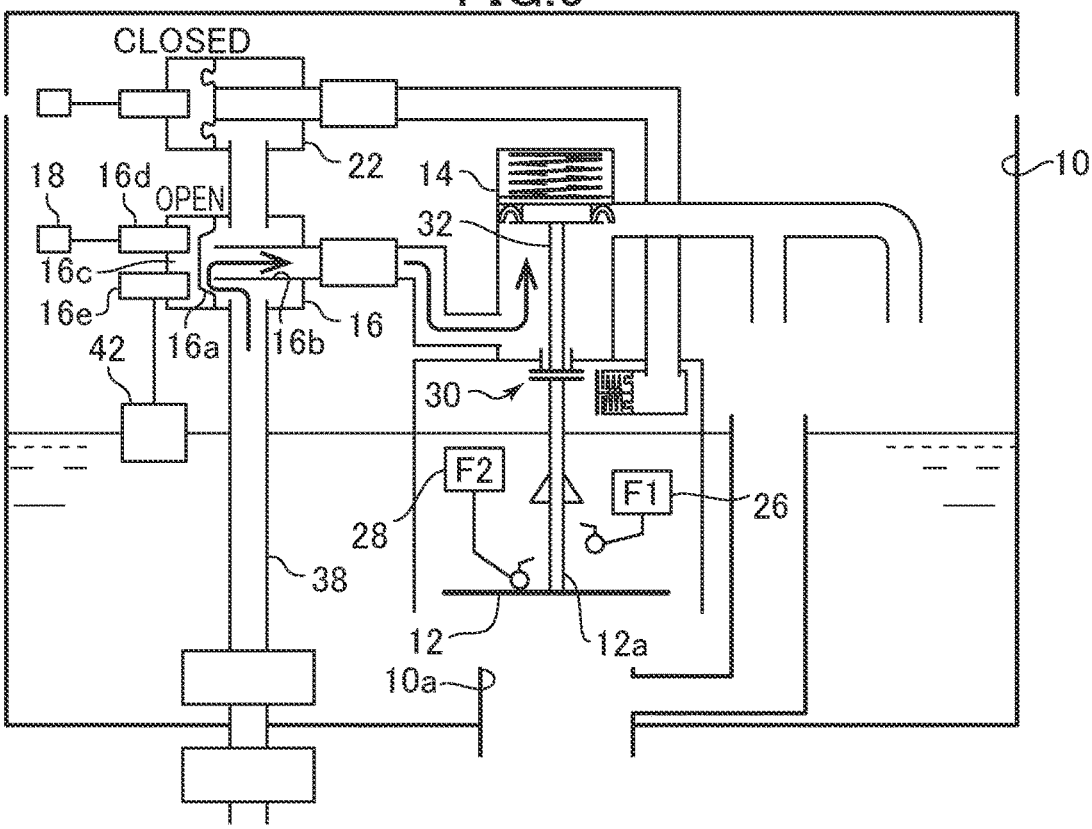
FIG. 5 is a diagram showing operation in a large washing mode of the flush water tank apparatus according to the first embodiment of the present invention.

When an instruction signal to perform large washing is received, as shown in FIG. 5, the controller 40 actuates the solenoid valve 18 provided in the first control valve 16 to make the pilot valve 16*d* on the solenoid valve side leave from the pilot valve port. Thereby, the pressure in the pressure chamber 16*c* drops; the main valve body 16*a* leaves from the main valve port 16*b*; and the main valve port 16*b* is opened. Note that when large washing is selected, the second control valve 22 is consistently closed, and thus, no flush water is supplied to the adjustment mechanism 58. When the first control valve 16 is opened, flush water flowing in from the water supply pipe 38 is supplied to the discharge valve hydraulic drive unit 14 via the first control valve 16. Consequently, the piston 14*b* of the discharge valve hydraulic drive unit 14 is pushed up, the discharge valve 12 is pulled up via the discharge valve driving rod 32, and flush water in the storage tank 10 is discharged from the drain port 10*a* to the flush toilet main body 2.

Figure 6:
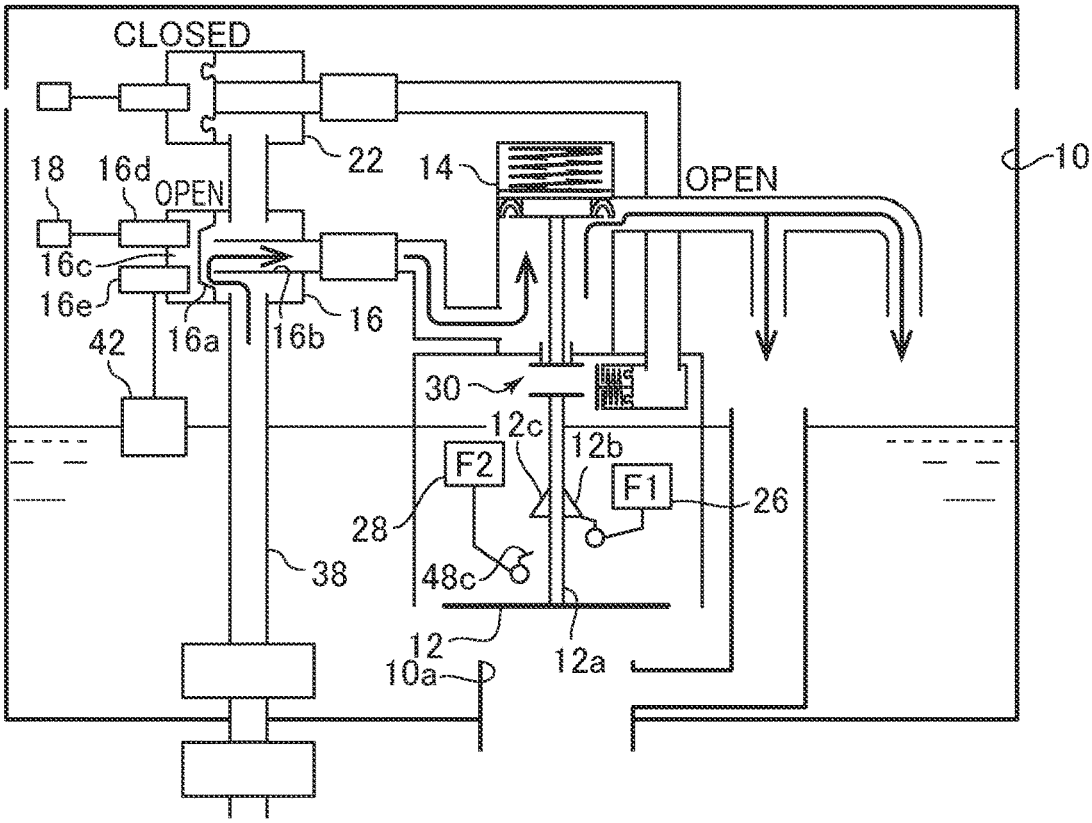
FIG. 6 is a diagram showing the operation in the large washing mode of the flush water tank apparatus according to the first embodiment of the present invention.

When the discharge valve 12 is pulled up, the holding claw 12*c* provided on the valve stem 12*a* of the discharge valve 12 pushes up and rotates the engaging member 48*c* of the second holding mechanism 48 and the holding claw 12*c* passes over the engaging member 48*c*. When the discharge valve 12 is further pulled up, the holding claw 12*b* pushes up and rotates the engaging member 46*c* of the first holding mechanism 46 and the holding claw 12*b* passes over the engaging member 46*c* (from FIG. 4A to FIG. 4B). Next, when the discharge valve 12 is further pulled up, the clutch mechanism 30 is disconnected as shown in FIG. 6. In other words, when the discharge valve 12 reaches a predetermined height, the upper end of the hook member 30*b* of the clutch mechanism 30 hits the bottom surface of the discharge valve hydraulic drive unit 14, and the clutch mechanism 30 is disconnected (FIG. 3B→FIG. 3C).

When the clutch mechanism 30 is disconnected, the discharge valve 12 starts to descend toward the drain port 10*a* due to its own weight. Here, just after the discharge valve 12 being opened, the water level in the storage tank 10 is high, and thus, each of the first holding mechanism 46 and the second holding mechanism 48 is in the holding state indicated by the solid lines in FIG. 4B). Therefore, the holding claw 12*b* of the discharge valve 12 that has descended engages with the engaging member 46*c* of the first holding mechanism 46, and the discharge valve 12 is held at a predetermined height by the first holding mechanism 46. By the discharge valve 12 being held by the first holding mechanism 46, the drain port 10*a* is kept in the open state, and discharge of flush water in the storage tank 10 to the flush toilet main body 2 is kept.

Figure 7:
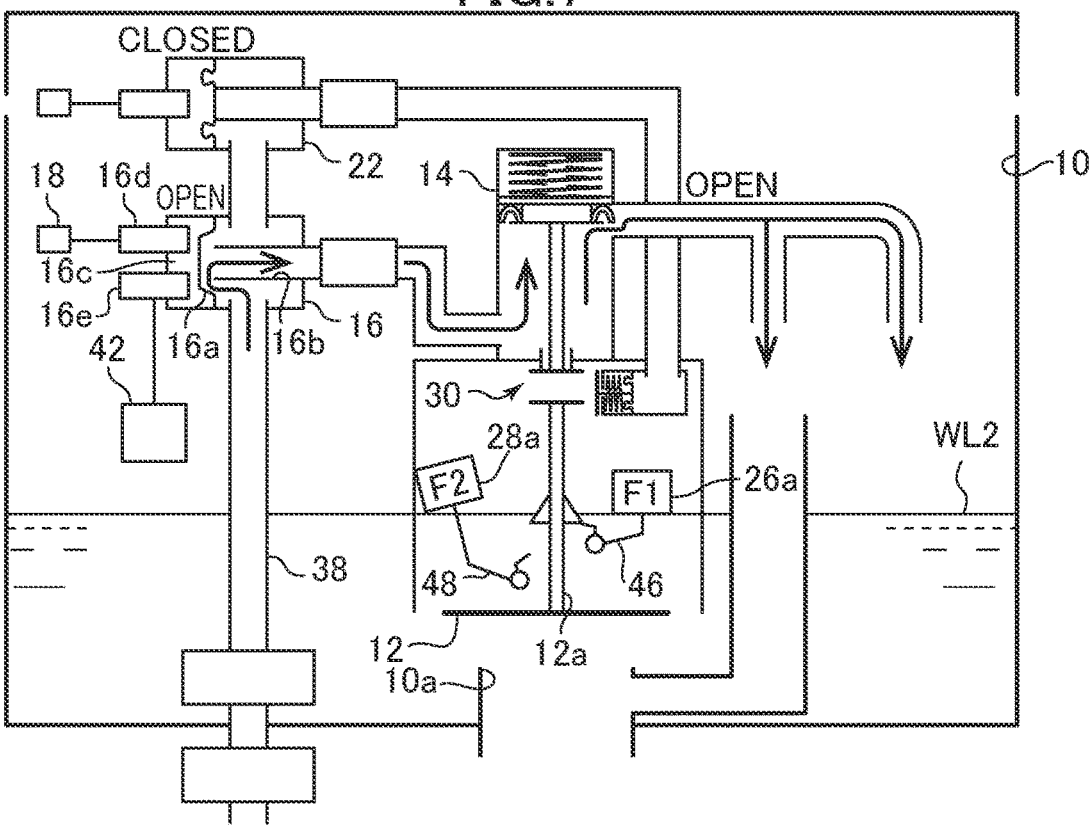
FIG. 7 is a diagram showing the operation in the large washing mode of the flush water tank apparatus according to the first embodiment of the present invention.

Then, when the water level in the storage tank 10 drops as shown in FIG. 7, the float switch 42 that detects the water level in the storage tank 10 is turned off. When the float switch 42 is turned off, the pilot valve 16*e* (FIG. 2) on the float switch side of the first control valve 16 is opened. When the pilot valve 16*e* is opened, the controller 40 actuates the solenoid valve 18 to close the pilot valve 16*d* on the solenoid valve side. As described above, the main valve body 16*a* of the first control valve 16 is configured to be closed when the pilot valve 16*e* on the float switch side and the pilot valve 16*d* on the solenoid valve side are both closed. Therefore, even after the pilot valve 16*d* on the solenoid valve side is closed, the first control valve 16 is kept open and water supply to the storage tank 10 is continued.

Also, as shown in FIG. 7, when the water level in the storage tank 10 drops to a predetermined water level WL2, the position of the second float 28*a* supported by the second holding mechanism 48 drops. Consequently, the second holding mechanism 48 transitions to the non-holding state indicated by the imaginary lines in FIG. 4B. On the other hand, since the first float 26*a* is supported at a position that is lower than the second float 28*a*, even in this state, the first holding mechanism 46 is kept in the holding state and discharge of flush water in the storage tank 10 is continued.

Figure 8:
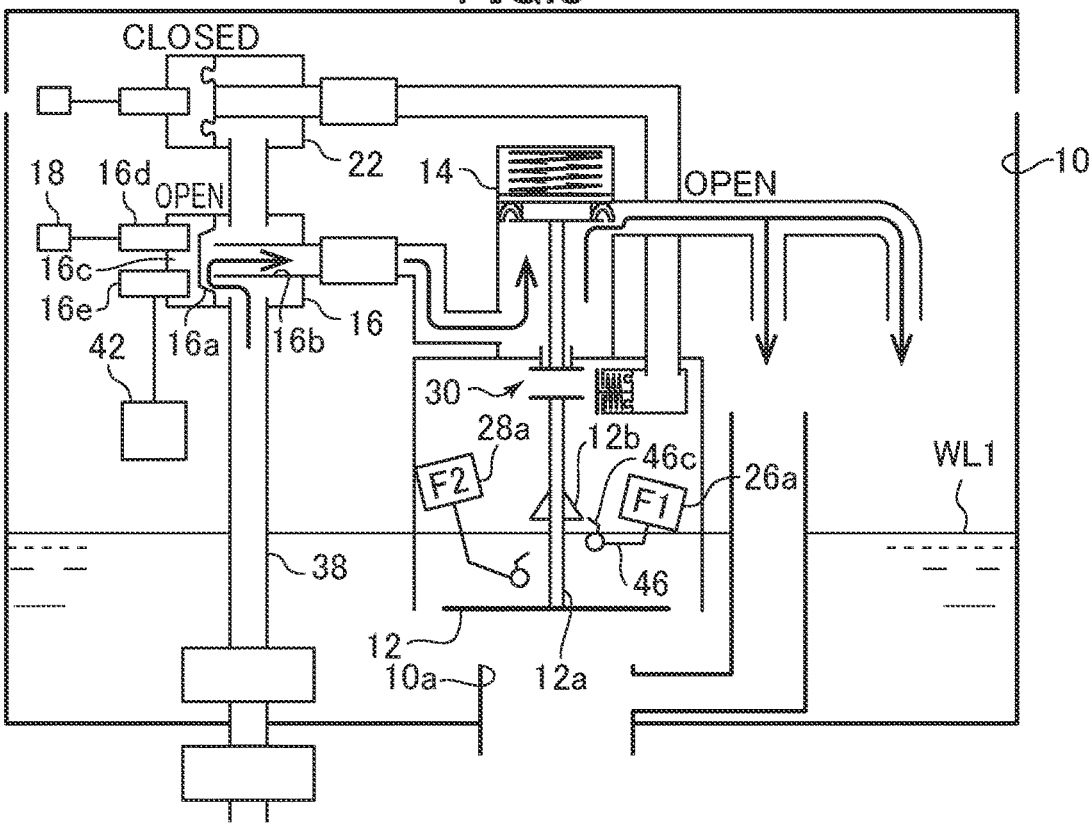
FIG. 8 is a diagram showing the operation in the large washing mode of the flush water tank apparatus according to the first embodiment of the present invention.

As show in FIG. 8, when the water level in the storage tank 10 further drops to a predetermined water level WL1 that is lower than the predetermined water level WL2, the position of the first float 26*a* supported by the first holding mechanism 46 also drops. Consequently, the first holding mechanism 46 transitions to the non-holding state indicated by the imaginary liens in FIG. 4B and engagement between the engaging member 46*c* and the holding claw 12*b* of the discharge valve 12 is released. As a result of the first holding mechanism 46 transitioning to the non-holding state, the discharge valve 12 starts descending again.

Figure 9:
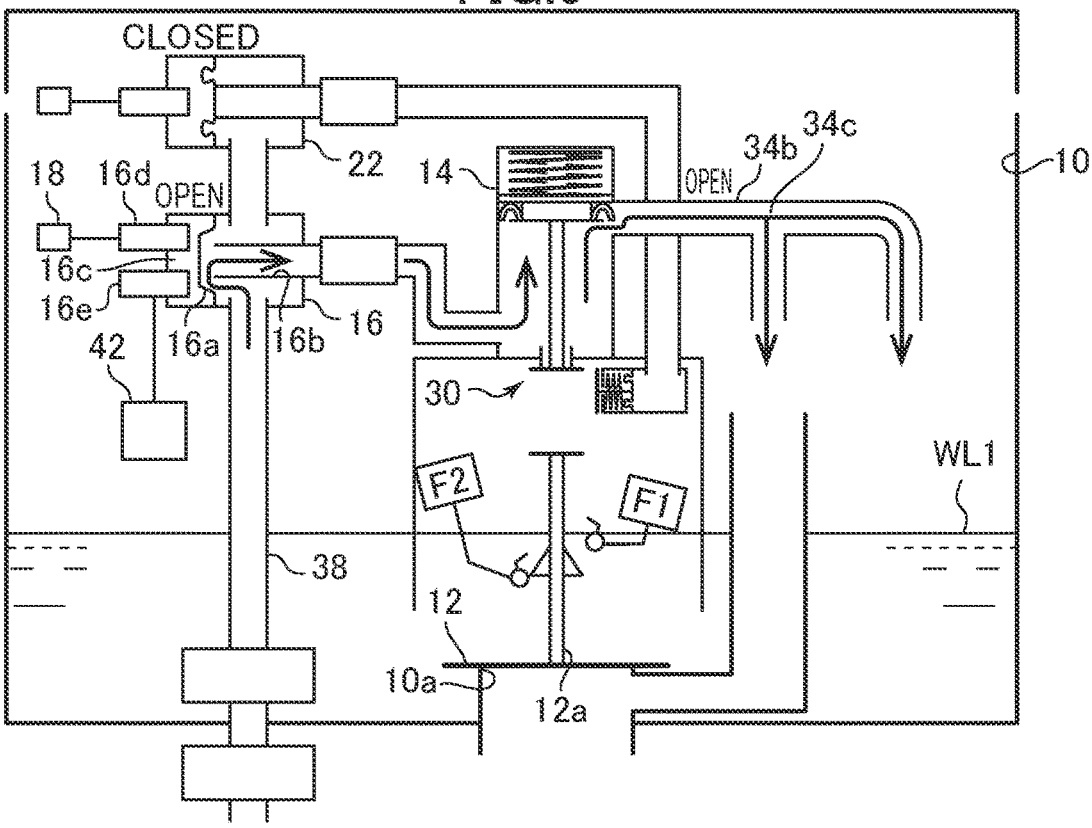
FIG. 9 is a diagram showing the operation in the large washing mode of the flush water tank apparatus according to the first embodiment of the present invention.

Thereby the discharge valve 12 seats on the drain port 10*a*, and the drain port 10*a* is closed as shown in FIG. 9. Thus, when the large washing mode is executed, the discharge valve 12 is held until the water level in the storage tank 10 drops from the full water level WL to the predetermined water level WL1, and the first amount of flush water is discharged to the flush toilet main body 2.

Since the float switch 42 is still in the off state, the open state of the first control valve 16 is kept, and water supply to the storage tank 10 is continued. The flush water supplied to the storage tank 10 reaches a discharge passage branch portion 34*c* (FIG. 2) through the discharge valve hydraulic drive unit 14 and a part of flush water branched in the discharge passage branch portion 34*c* flows into the overflow pipe 10*b* and the remainder is stored in the storage tank 10. The flush water flowing into the overflow pipe 10*b* flows into the flush toilet main body 2 and is used to refill the bowl 2*a*. By flush water flowing into the storage tank 10 in the state of the discharge valve 12 being closed, the water level in the storage tank 10 rises.

Figure 10:
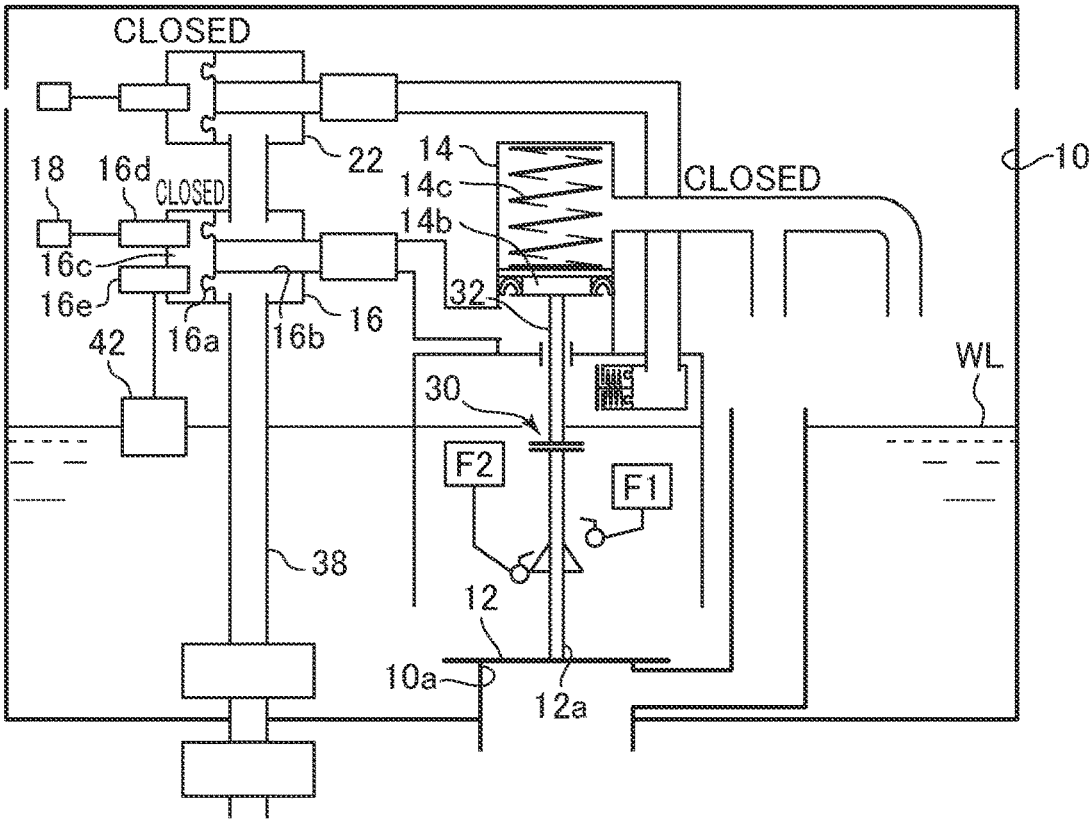
FIG. 10 is a diagram showing the operation in the large washing mode of the flush water tank apparatus according to the first embodiment of the present invention.

When the water level in the storage tank 10 rises to the full water level WL as shown in FIG. 10, the float switch 42 is turned on. When the float switch 42 is turned on, the pilot valve 16*e* (FIG. 2) on the float switch side is closed. Consequently, the pilot valve 16*e* on the float switch side and the pilot valve 16*d* on the solenoid valve side are both closed, and thus, the pressure inside pressure chamber 16*c* increases, the main valve body 16*a* of the first control valve 16 is closed and the water supply is thus stopped. When the water supply to the discharge valve hydraulic drive unit 14 is stopped, the piston 14*b* of the discharge valve hydraulic drive unit 14 is pushed down by the energizing force of the spring 14*c*, and the discharge valve driving rod 32 descends together with the piston 14*b*. Consequently, the clutch mechanism 30 is connected (FIGS. 3E to 3H) and thus returns to the standby state before the start of toilet washing.

Next, operation of the small washing mode will be described with reference to FIG. 2, and FIGS. 11 to 15.

As shown in FIG. 2, the toilet washing standby state is similar to that of the large washing.

When receiving an instruction signal to perform small washing, the controller 40 causes the solenoid valve 18 provided for the first control valve 16 to operate to open the first control valve 16. The controller 40 actuates the solenoid valve 24 provided in the second control valve 22 to open the pilot valve 22*c* to supply flush water to the water supply passage 50 extending from the second control valve 22. Accordingly, flush water is supplied from the water supply passage 50 to the adjustment mechanism 58.

Figure 11:
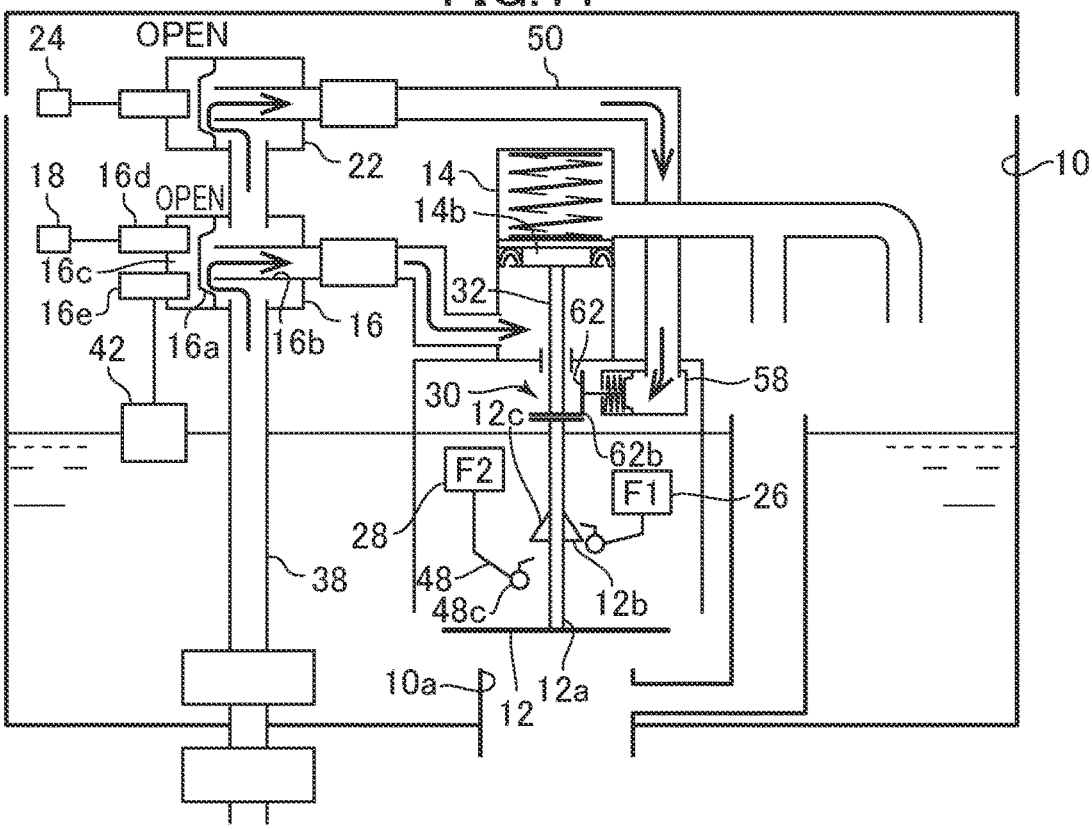
FIG. 11 is a diagram showing operation in a small large washing mode of the flush water tank apparatus according to the first embodiment of the present invention.

When the first control valve 16 is opened, flush water flowing in from the water supply pipe 38 is supplied to the discharge valve hydraulic drive unit 14 via the first control valve 16 as shown in FIG. 11. Consequently, the piston 14*b* of the discharge valve hydraulic drive unit 14 is pushed up, the discharge valve 12 is pulled up via the discharge valve driving rod 32, and flush water in the storage tank 10 is discharged from the drain port 10*a* to the flush toilet main body 2. Note that, when the discharge valve 12 is pulled up, the holding claw 12*c* (FIG. 4A) provided on the valve stem 12*a* of the discharge valve 12 pushes up and rotates the engaging member 48*c* of the second holding mechanism 48, and the holding claw 12*c* gets over the engaging member 48*c*.

In the adjustment mechanism 58, as flush water is supplied from the water supply passage 50 into the cylinder portion 60, the rod member 62 is moved horizontally toward the discharge valve driving rod 32 by water pressure. The T-shape part of the rod member 62 is arranged right above the clutch mechanism 30. The rod member 62 of the adjustment mechanism 58 is moved to a disconnection position at which the clutch mechanism 30 is disconnected, before the discharge valve 12 reaches the pull-up height with which the clutch mechanism 30 is disconnected by the bottom surface of the discharge valve hydraulic drive unit 14. Therefore, the upper end of the hook member 30*b* of the clutch mechanism 30 moving upward hits the lower end 62*b* of the T-shape and the clutch mechanism 30 is thus disconnected. The rod member 62 is left at the disconnection position for a predetermined time even after the discharge valve 12 reaches the pull-up height with which the clutch mechanism 30 is disconnected.

Figure 12:
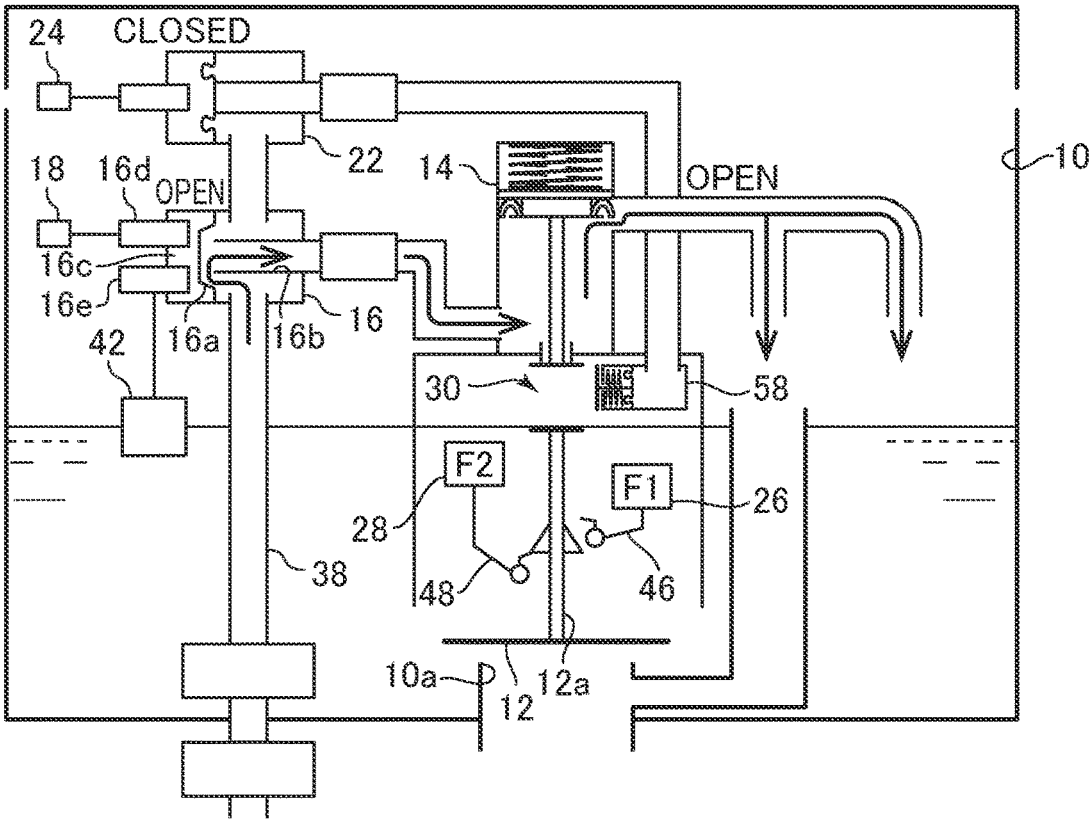
FIG. 12 is a diagram showing the operation in the small large washing mode of the flush water tank apparatus according to the first embodiment of the present invention.

As shown in FIGS. 11 and 4B, when the second amount of flush water is selected by the remote controller 6, when each of the holding claw 12*b* and the holding claw 12*c* of the discharge valve 12 is located at a height position between the first height position L1 and the second height position L2, the clutch mechanism 30 is disconnected by the adjustment mechanism 58. When the clutch mechanism 30 is disconnected, the discharge valve 12 starts to descend toward the drain port 10*a* due to its own weight. Here, just after the discharge valve 12 being opened, the water level in the storage tank 10 is high, and thus, the second holding mechanism 48 is kept in the holding state indicated by the solid lines in FIG. 4B. Note that the first holding mechanism 46 is also kept in the holding state indicated by the imaginary lines in FIG. 4B. However, since the clutch mechanism 30 is disconnected when each of the holding claw 12*b* and the holding claw 12*c* of the discharge valve 12 is located at a height position between the first height position L1 and the second height position L2, as shown in FIG. 12, the holding claw 12*c* of the descending discharge valve 12 engages with the engaging member 48*c* of the second holding mechanism 48, and the discharge valve 12 is kept at a predetermined height by the second holding mechanism 48.

Here, when the discharge valve 12 is held by the second holding mechanism 48, the discharge valve 12 is held at a position that is lower than that of a case where the discharge valve 12 is held by the first holding mechanism 46. When the discharge valve 12 is held by the second holding mechanism 48, the drain port 10*a* is kept open and discharge of flush water in the storage tank 10 to the flush toilet main body 2 is kept. Also, after a lapse of a time sufficient for the clutch mechanism 30 to be disconnected, the controller 40 transmits a signal to the solenoid valve 24 (FIG. 2) at a predetermined timing to close the second control valve 22. Consequently, the supply of flush water to the adjustment mechanism 68 is stopped. Therefore, the pressure of flush water in the cylinder portion 60 decreases, and the rod member 62 is thus pulled back to the cylinder portion 60 side by the spring 64.

Figure 13:
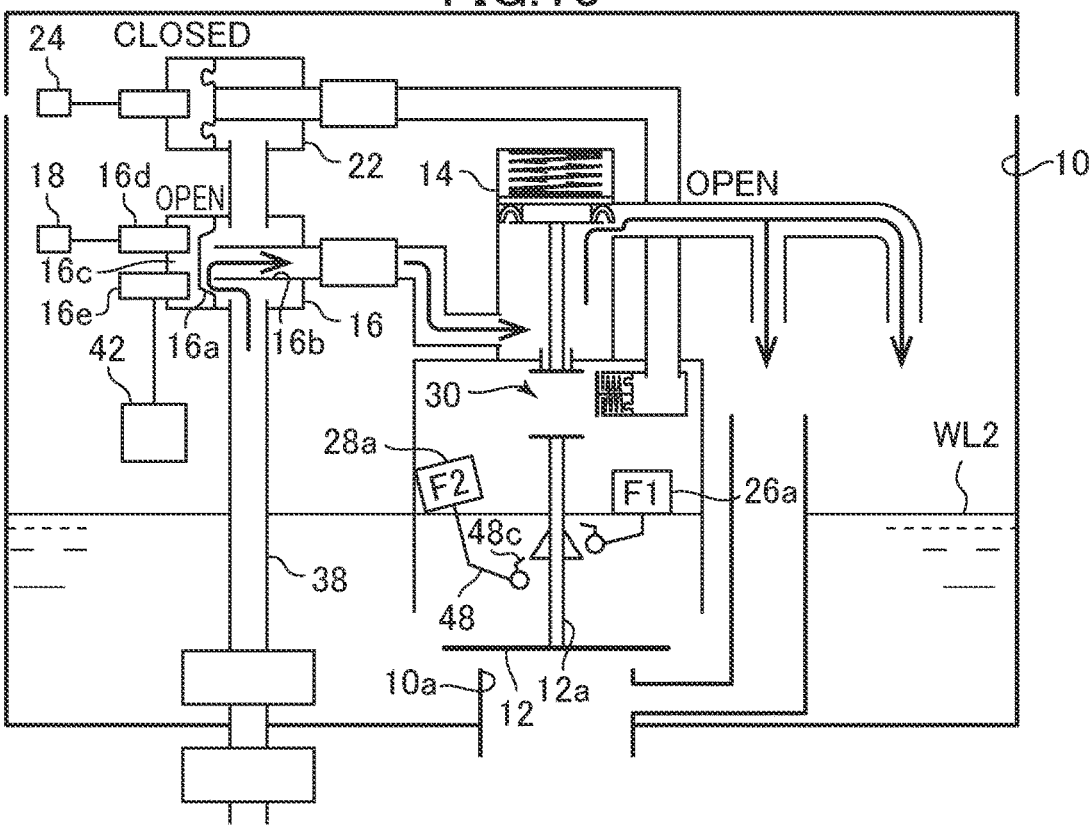
FIG. 13 is a diagram showing the operation in the small large washing mode of the flush water tank apparatus according to the first embodiment of the present invention.

Then, when the water level in the storage tank 10 drops as shown in FIG. 13, the float switch 42 detecting the water level in the storage tank 10 is turned off. When the float switch 42 is turned off, the pilot valve 16*e* (FIG. 2) on the float switch side provided in the first control valve 16 is opened. When the pilot valve 16*e* is opened, the controller 40 actuates the solenoid valve 18 to close the pilot valve 16*d* on the solenoid valve side. Consequently even after the pilot valve 16*d* on the solenoid valve side is closed, the first control valve 16 is kept open and the water supply of the storage tank 10 is continued.

Also, as shown in FIG. 13, when the water level in the storage tank drops, the position of the second float 28*a* supported by the second holding mechanism 48 also drops. Consequently, the second holding mechanism 48 transitions to the non-holding state indicated by the imaginary lines in FIG. 4B. Consequently, engagement between the engaging member 48*c* and the holding claw 12*c* of the discharge valve 12 is released. As a result of the second holding mechanism 48 transitioning to the non-holding state, the discharge valve 12 starts descending again.

Figure 14:
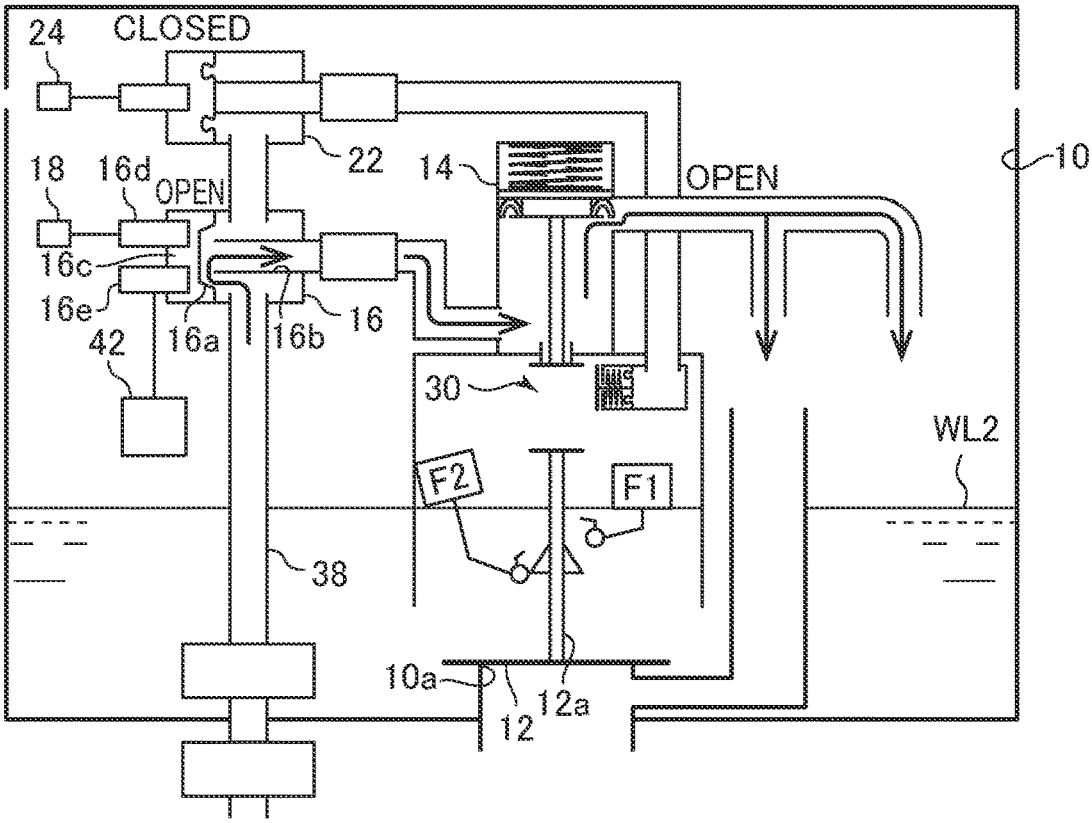
FIG. 14 is a diagram showing the operation in the small large washing mode of the flush water tank apparatus according to the first embodiment of the present invention.

Then, the discharge valve 12 seats on the drain port 10*a*, and the drain port 10*a* is closed as shown in FIG. 14. In this way, when the small washing mode is executed, the discharge valve 12 is held until the water level in the storage tank 10 drops from the full water level WL to the predetermined water level WL2, and the second amount of flush water is discharged to the flush toilet main body 2. Here, in the large washing mode, the discharge valve 12 is held until the water level in the storage tank 10 drops to the predetermined water level WL1 that is lower than the predetermined water level WL2. Therefore, the second amount of flush water discharged from the storage tank 10 in the small washing mode is smaller than the first amount of flush water discharged in the large washing mode.

On the other hand, since the float switch 42 is still off, the first control valve 16 is kept open and the water supply to the storage tank 10 is continued. As a result of flush water flowing into the storage tank 10 with the discharge valve 12 closed, the water level in the storage tank 10 rises.

Figure 15:
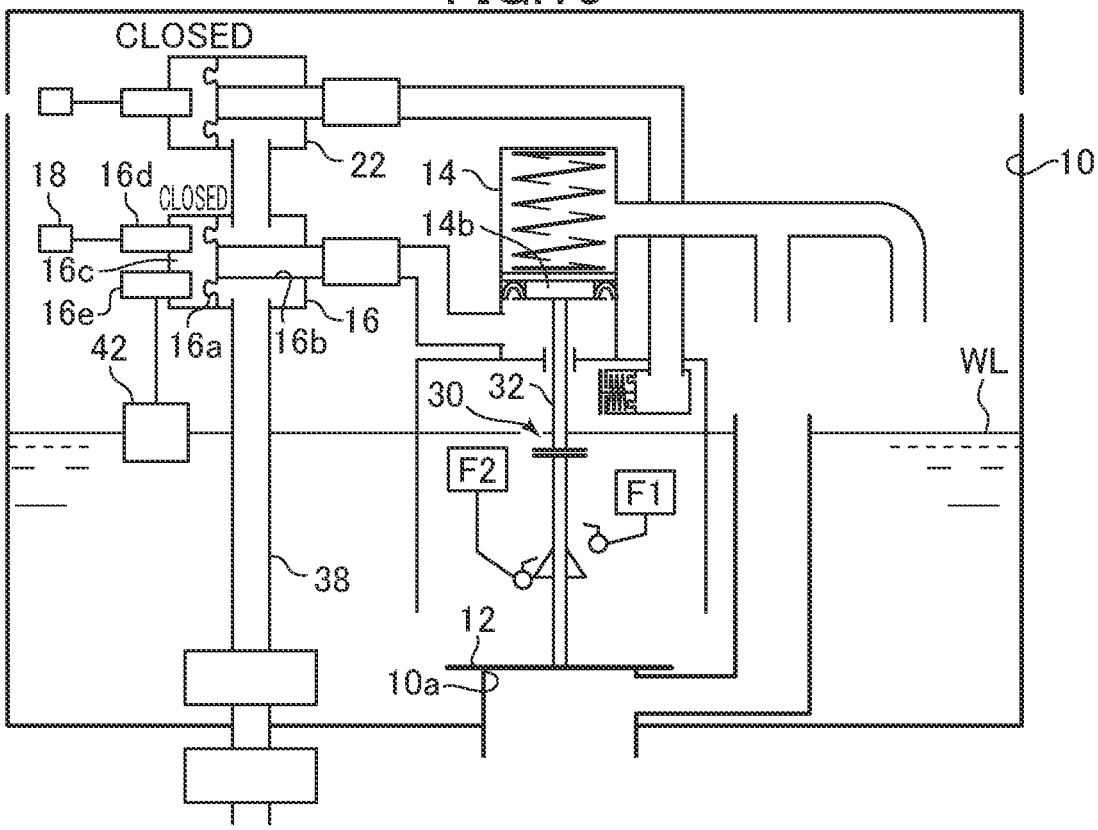
FIG. 15 is a diagram showing the operation in the small large washing mode of the flush water tank apparatus according to the first embodiment of the present invention.

Furthermore, as shown in FIG. 15, when the water level in the storage tank 10 rises to the predetermined full water level WL, the float switch 42 is turned on and the pilot valve 16*e* on the float switch side is closed. Consequently, since the pilot valve 16*e* on the float switch side and the pilot valve 16*d* on the solenoid valve side are both closed, the main valve body 16*a* of the first control valve 16 is closed and the water supply is thus stopped. When the water supply to the discharge valve hydraulic drive unit 14 is stopped, the piston 14*b* of the discharge valve hydraulic drive unit 14 is pushed down and the discharge valve driving rod 32 descends together with the piston 14*b*. Consequently, the clutch mechanism 30 is connected (FIGS. 3E to 3H) and returns to the standby state before the start of toilet washing (state in FIG. 2).

With the above-described flush water tank apparatus 4 according to the first embodiment of the present invention, the discharge valve 12 and the discharge valve hydraulic drive unit 14 are coupled by the clutch mechanism 30 and decoupled with the predetermined pull-up height of the discharge valve 12, and thus, it is possible to, regardless of an operation speed of the discharge valve hydraulic drive unit 14, move the discharge valve 12 and close the discharge valve 12. Thereby, it becomes possible to, even if the operation speed of the discharge valve hydraulic drive unit varies at the time of causing the discharge valve to descend, control the timing of causing the discharge valve to be closed without being influenced by the variation. Also, the adjustment mechanism 58 is configured so that when the second amount of flush water is selected by the remote controller 6, the clutch mechanism 30 is disconnected at a pull-up height of the discharge valve 12 such that the discharge valve 12 descended by the disconnection of the clutch mechanism 30 is held by the second float device 28. Consequently, the second float device 28 enables stable discharge of the second amount of flush water to the flush toilet. Therefore, the first embodiment of the present invention enables setting the first and second amounts of flush water while using the clutch mechanism 30.

Furthermore, with the flush water tank apparatus 4 according to the first embodiment of the present invention, the adjustment mechanism 58 is configured so that when the second amount of flush water is selected by the remote controller 6 and the clutch mechanism 30 is disconnected when an engaging portions of the discharge valve 12 for the first float device 26 and the second float device 28 is located at a height position between the first height position L1 and the second height position L2. Consequently, the second float device 28 enables stable discharge of the second amount of flush water to the flush toilet. Also, when the second amount of flush water is selected by the remote controller 6, even if the adjustment mechanism 58 fails to disconnect the clutch mechanism 30 when an engaging portions of the discharge valve 12 for the first float device 26 and the second float device 28 is located at a height position between the first height position L1 and the second height position L2, resulting in the discharge valve 12 being pulled up higher, the relevant engaging portion of the discharge valve 12 can engage with the first float device 26 in the holding state, enabling the first amount of flush water, which is larger than the second amount of flush water, to be discharged to the flush toilet. Consequently, a failure in washing of the flush toilet can be curbed.

Furthermore, with the flush water tank apparatus 4 according to the first embodiment of the present invention, the adjustment mechanism 58 is provided with the rod member 62 that is horizontally movable, and the clutch mechanism 30 is disconnected by contacting the rod member 62 of the adjustment mechanism 58 with the clutch mechanism 30. Consequently, for example, in comparison with a case where flush water discharged by the adjustment mechanism 58 is made to collide with the clutch mechanism 30, the clutch mechanism 30 can more reliably be disconnected by the rod member 62 being brought into physical contact with the clutch mechanism 30.

Furthermore, with the flush water tank apparatus 4 according to the first embodiment of the present invention, the moving direction in which the rod member 62 of the adjustment mechanism 58 moves and the parting direction in which the clutch mechanism 30 is disconnected and moves away are different from each other. Consequently, in comparison with a provisional case where the moving direction in which the rod member 62 moves and the parting direction in which the clutch mechanism 30 is disconnected and moves away are the same, the clutch mechanism 30 can more reliably be disconnected.

Furthermore, with the flush water tank apparatus 4 according to the first embodiment of the present invention, the clutch mechanism 30 reaches the rod member 62 that has reached at the disconnection position, while the clutch mechanism 30 being pulled up, and thus, as in a case where the first amount of flush water is selected and the clutch mechanism 30 is disconnected at the predetermined pull-up height of the discharge valve 12, the clutch mechanism 30 can be disconnected while the clutch mechanism 30 being pulled up, enabling the clutch mechanism 30 to be disconnected more reliably.

Furthermore, with the flush water tank apparatus 4 according to the first embodiment of the present invention, even after the discharge valve 12 reaches the pull-up height at which the clutch mechanism 30 is disconnected, the rod member 62 of the adjustment mechanism 58 remains at the disconnection position for a predetermined time, enabling more enhancement in reliability of disconnection of the clutch mechanism 30.

Furthermore, with the flush water tank apparatus 4 according to the first embodiment of the present invention, the adjustment mechanism 58 is configured to move the rod member 62 by supplied flush water, and thus, the clutch mechanism 30 can be disconnected via a compact and simple structure using supply of flush water.

Also, with the flush water tank apparatus 4 of the first embodiment of the present invention, the discharge valve 12 and the discharge valve hydraulic drive unit 14 are coupled by the clutch mechanism 30 and decoupled at a predetermined timing, and thus, it is possible to, regardless of the operation speed of the discharge valve hydraulic drive unit 14, move the discharge valve 12 and close the discharge valve 12. Also, by the adjustment mechanism 58, which is a valve control hydraulic drive unit, making operational force act on the clutch mechanism 30 forming a discharge valve holding mechanism, when the second amount of flush water is selected, the discharge valve 12 is made to descend to block the drain port 10*a* earlier than a case where the first amount of flush water is selected. Therefore, it is possible to set the first and second amounts of flush water while using the clutch mechanism 30.

Also, with the flush water tank apparatus 4 of the first embodiment, since a volume of the pressure chamber 58*a* provided in the adjustment mechanism 58 is smaller volume than a volume of the cylinder 14*a* provided in the discharge valve hydraulic drive unit 14, the rod member 62 can be driven merely by a small amount of flush water being supplied. Therefore, responsiveness of the adjustment mechanism 58 can be enhanced.

Furthermore, with the flush water tank apparatus 4 of the first embodiment, by the rod member 62 driven by water supply pressure of tap water flowing into the pressure chamber 58*a* being made to project toward the clutch mechanism 30, operational force can be made to act on the clutch mechanism 30. Therefore, in comparison with a case where the rod member 62 is configured to be drawn into the pressure chamber 58*a*, there is no need to provide a shaft seal between the pressure chamber 58*a* and the rod member 62, enabling elimination of sliding resistance due to a shaft seal.

Also, with the flush water tank apparatus 4 of the first embodiment, since the elastic film 58*b* is provided as a drive portion that drives the rod member 62, in comparison with a case where a piston that slides inside a cylinder is used as a drive portion, there is no need to provide a slide seal for a piston, enabling elimination of sliding resistance of the piston.

Furthermore, with the flush water tank apparatus 4 of the first embodiment, engagement between the discharge valve 12 and the discharge valve hydraulic drive unit 14 via the clutch mechanism 30 can be released at the early timing by driving the rod member 62 based on water supply pressure of tap water. Therefore, it is possible to control a timing for releasing engagement via the clutch mechanism 30, enabling switching between plural flush water amounts.

Also, with the flush water tank apparatus 4 of the first embodiment, the discharge valve 12 can be held at two height positions by the first float device 26 and the second float device 28, enabling accurately setting the first amount of flush water and the second amount of flush water. Also, when the second amount of flush water is selected, the engagement via the clutch mechanism 30 is released with a position that is higher than the second height position at which the discharge valve 12 engages with the second float device 28 but is lower than the first height position at which the discharge valve 12 engages with the first float device 26, and thus, it is possible to switch the float device to act, according to the selected flush water amount to set an amount of flush water to be discharged.

Furthermore, with the flush water tank apparatus 4 of the first embodiment, the direction in which the rod member 62 projects intersects with the direction in which the discharge valve 12 is pulled up via the clutch mechanism 30, and thus, the engagement via the clutch mechanism 30 can reliably be released by the rod member 62.

Also, with the flush water tank apparatus 4 of the first embodiment, after the rod member 62 projects, the upper end of the hook member 30*b* of the clutch mechanism 30 contacts with the rod member 62, and thus, the engagement via the clutch mechanism 30 can reliably be released by the rod member 62.

Furthermore, with the flush water tank apparatus 4 of the first embodiment, a timing for supplying tap water to the adjustment mechanism 58 is earlier than a timing for supplying tap water to the discharge valve hydraulic drive unit 14, and thus, the engagement via the clutch mechanism 30 can reliably be released by the rod member 62 actuated at the early timing by the adjustment mechanism 58.

Furthermore, the flush toilet apparatus 1 having a plurality of washing modes that are different in flush water amount, according to the first embodiment of the present invention includes the flush toilet main body 2 and the flush water tank apparatus 4 that supplies flush water to the flush toilet main body 2.

The first embodiment of the present invention has been described above. Various changes can be added to the first embodiment described above. For example, in the above-described first embodiment, the adjustment mechanism 58 is formed by a piston cylinder; however, the adjustment mechanism 58 may be formed by a discharge portion that discharges water. The discharge portion is provided at an end portion of the water supply passage 50 and is arranged below the bottom surface of the discharge valve hydraulic drive unit 14 and arranged to direct toward the valve stem 12*a* side. By flush water discharged from the discharge portion hitting the hook member 30*b* of the clutch mechanism 30, the hook member 30*b* is rotated and the clutch mechanism 30 is thus disconnected. Therefore, by the hook member 30*b* of the clutch mechanism 30 hitting a water flow at a position that is lower than the bottom surface of the discharge valve hydraulic drive unit 14, the clutch mechanism 30 is disconnected, enabling the discharge valve to descend. Consequently, the clutch mechanism 30 can be disconnected at a pull-up height of the discharge valve 12 such that the discharge valve 12 is held by the second float device 28 in the holding state.

Also, for example, in the present embodiment, the adjustment mechanism 58 is formed by a piston cylinder; however, the adjustment mechanism 58 may be provided with a discharge portion provided at the end portion of the water supply passage 50, a water storage portion that receives flush water discharged from the discharge portion, and a rod member that when the water storage portion descends because of weight of flush water pooled therein, moves horizontally by being pushed by the water storage portion. A discharge hole from which flush water is gradually discharged is formed in the water storage portion and a spring that when the water storage portion becomes empty, raises the water storage portion to a standby position is connected to the water storage portion. Flush water is discharged from the discharge portion to the water storage portion to make the water storage portion descend and thereby extend the T-shape part of the rod member to the lower side relative to the bottom surface of the discharge valve hydraulic drive unit 14, whereby the clutch mechanism 30 is disconnected at the early timing by the rod member. More specifically, a plate of the T-shape part of the rod member hits the hook member 30*b* on the lower side relative to the bottom surface of the discharge valve hydraulic drive unit 14 and the hook member 30*b* is thereby rotated, whereby the clutch mechanism 30 is disconnected. Consequently, the clutch mechanism 30 can be disconnected at a pull-up height of the discharge valve 12 such that the discharge valve 12 is held by the second float device 28 in the holding state.

Also, for example, in the present embodiment, the adjustment mechanism 58 is formed by a piston cylinder; however, as a modification, the adjustment mechanism 58 may be provided with a discharge portion provided at the end portion of the water supply passage 50, a water storage portion that receives flush water discharged from the discharge portion, a float arranged inside the water storage portion, a seesaw-like force transmission device, and a rod member that when an end portion on the side of the float of the force transmission device descends, moves horizontally by being pushed by the end portion. The water storage portion and the float in the water storage portion are provided above the full water level WL. With the water storage portion, in the standby state, no flush water is pooled in the water storage portion. By the discharge portion supplying flush water to the water storage portion, the float ascends and an end of the force transmission device, the end being connected to the float, ascends. The force transmission device is a seesaw-like force transmission device, and a rotation center shaft is provided at a center of the force transmission device, and when one end of the force transmission device ascends, the other end of the force transmission device descends like a seesaw, and the descending other end pushes the rod member horizontally. In order to push the rod member horizontally, the other end of the force transmission device forms a sloped surface sloped obliquely downward. The rod member is provided with a T-shape part on the distal end side, and the clutch mechanism 30 is disconnected at the early timing by the rod member by extending the T-shape part of the rod member to the lower side relative to the bottom surface of the discharge valve hydraulic drive unit 14. Therefore, upon ascent of the float, the rod member moves to the valve stem 12*a* side on the opposite side of the seesaw-like force transmission device and acts on the clutch mechanism 30, whereby the clutch mechanism 30 can be disconnected at the early timing. More specifically, the plate of the T-shape part of the rod member hits the hook member 30*b* on the lower side relative to the bottom surface of the discharge valve hydraulic drive unit 14 and the hook member 30*b* is thereby rotated, whereby the clutch mechanism 30 is disconnected. Consequently, the clutch mechanism 30 can be disconnected at a pull-up height of the discharge valve 12 such that the discharge valve 12 is held by the second float device 28 in the holding state.

Here, in the above-described embodiment, the first float device 26 and the second float device 28 are provided, and when the small washing mode is executed, the adjustment mechanism 58 is actuated so that the discharge valve 12 is held by the second float device 28. In other words, when the small washing mode is executed, the rod member 62 of the adjustment mechanism 58 is made to project toward the clutch mechanism 30 to release the engagement via the clutch mechanism 30 with a position that is higher than the second height position at which the discharge valve 12 engages with the second float device 28 but is lower than the first height position at which the discharge valve 12 engages with the first float device 26. On the other hand, as a first modification, the present invention can be configured so that the rod member 62 of the adjustment mechanism 58 projects toward the first float device 26 for the large washing mode. In other words, when the small washing mode is selected, the rod member 62 of the adjustment mechanism 58 is made to project toward the first float 26*a* to forcibly switch the first float 26*a* into the non-holding state. Consequently, when the engagement via the clutch mechanism 30 is released, the discharge valve 12 is held by the second float device 28 for the small washing mode, enabling hastening a timing for the drain port 10*a* to be closed. In this modification, the clutch mechanism 30 and the first float device 26 function as a discharge valve holding mechanism.

Also, as a second modification, the present invention may be configured in such a manner as to include only one float device. In other words, the flush water tank apparatus is configured so that when either the large washing mode or the small washing mode is selected, the discharge valve 12 is held by one float device. When the large washing mode is executed, the water level in the storage tank 10 drops and the float device is thereby switched into the non-holding state, whereby the discharge valve 12 is closed. Then, when the small washing mode is selected, the rod member 62 of the adjustment mechanism 58 is made to project toward the float at a predetermined timing, whereby the float device is forcibly switched into the non-holding state. In this configuration, when the small washing mode is selected, the rod member 62 of the adjustment mechanism 58 is made to project toward the float at the early timing. Consequently, when the small washing mode is selected, a timing for the drain port 10*a* to be closed can be hastened in comparison with a case when the large washing mode is selected. In this modification, the clutch mechanism 30 and the single float device function as a discharge valve holding mechanism.

Alternatively, as a modification of the second modification, a configuration in which a part of flush water supplied to the discharge valve hydraulic drive unit 14 is supplied to the adjustment mechanism 58 to draw in the rod member 62 of the adjustment mechanism 58 and thereby switch the float device in the non-holding state into the holding state. In this configuration, when the large washing mode is selected, supply of flush water to the discharge valve hydraulic drive unit 14 is continued until the float device is switched into the non-holding state because of a water level drop. On the other hand, when the small washing mode is selected, supply of flush water to the discharge valve hydraulic drive unit 14 is stopped at the early timing and supply of flush water to the adjustment mechanism 58 is thereby stopped. Consequently, the rod member 62 is made to project and the float device is switched into the non-holding state. As a result, it is possible to, when the small washing mode is selected, hasten a timing for the drain port 10*a* to be closed. In this modification, the clutch mechanism 30 and the single float device function as a discharge valve holding mechanism.

Furthermore, as a third modification, the present invention can be configured so that the clutch mechanism 30 is disconnected at a predetermined timing by movement of the rod member 62 of the adjustment mechanism 58 without using a float device. In other words, the rod member 62 of the adjustment mechanism 58 is arranged in such a manner as to project toward the clutch mechanism 30. Furthermore, the clutch mechanism 30 is configured in such a manner as not to be disconnected even if the discharge valve 12 is pulled up to an upper limit and as to be disconnected by the rod member 62 of the adjustment mechanism 58 projecting. In this configuration, when the small washing mode is selected, the rod member 62 is made to project earlier than that in a case when the large washing mode is selected, enabling hastening a timing for the drain port 10*a* to be closed when the small washing mode is selected. In this modification, the clutch mechanism 30 functions as a discharge valve holding mechanism.

Alternatively, as a modification of the third modification, the rod member 62 of the adjustment mechanism 58 is arranged in advance at a position at which the engagement via the clutch mechanism 30 is released. In this modification, a part of flush water supplied to the discharge valve hydraulic drive unit 14 is supplied to the adjustment mechanism 58 to draw the rod member 62 of the adjustment mechanism 58 into a position at which the rod member 62 is not in contact with the clutch mechanism 30, by pressure of the water supply. In this configuration, when the small washing mode is selected, flush water supplied to the discharge valve hydraulic drive unit 14 is stopped at earlier timing than that in a case where the large washing mode is selected. Consequently, when the small washing mode is selected, the rod member 62 projects at the early timing, enabling hastening a timing for the drain port 10*a* to be closed. In this modification, the clutch mechanism 30 functions as a discharge valve holding mechanism.

Next a flush toilet apparatus according to a second embodiment of the present invention will be described with reference to the accompanying drawings.

Figure 16:
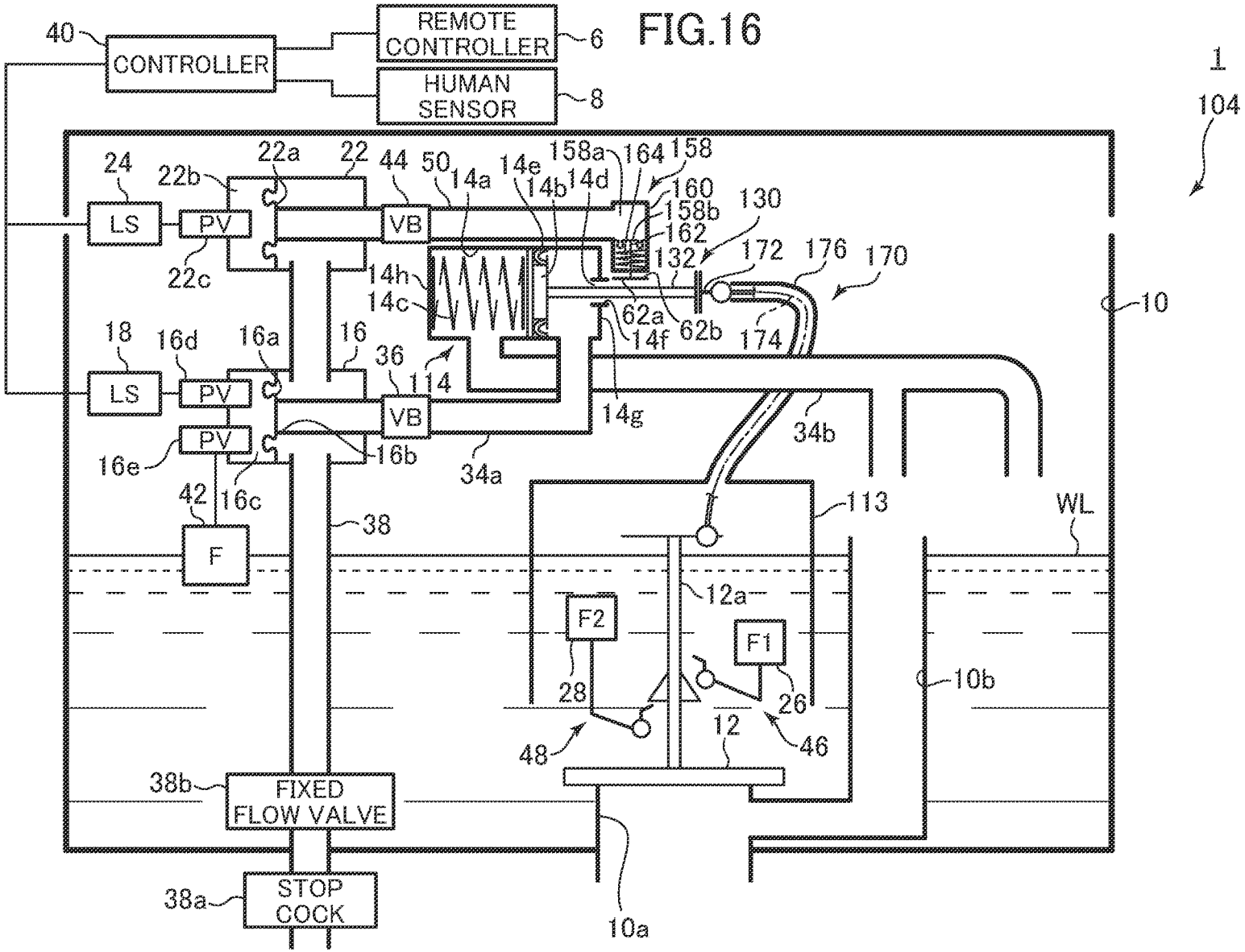
FIG. 16 is a sectional view showing a schematic configuration of a flush water tank apparatus according to a second embodiment of the present invention.

A flush toilet apparatus 1 of the second embodiment is different from the above-described first embodiment in that a clutch mechanism 130 is arranged outside a discharge valve casing 113. Here, the second embodiment of the present invention will be described only in terms of differences from the first embodiment and parts that are similar to those of the first embodiment are provided with reference numerals that are the same as those of the first embodiment in the drawing and description thereof will be omitted. FIG. 16 is a sectional view showing a schematic configuration of a flush water tank apparatus according to the second embodiment of the present invention.

As shown in FIG. 16, as in the first embodiment of the present invention, a flush water tank apparatus 104 according to the second embodiment of the present invention is provided in a flush toilet apparatus 1 (see FIG. 1).

The flush water tank apparatus 104 supplies flush water to a flush toilet main body 2. The flush water tank apparatus 104 has a discharge valve hydraulic drive unit 114 that drives a discharge valve 12.

The flush water tank apparatus 104 has a clutch mechanism 130 that upon being disconnected, makes the discharge valve 12 descend. The clutch mechanism 130 couples the discharge valve 12 and the discharge valve hydraulic drive unit 114 to pull up the discharge valve 12 by a driving force of the discharge valve hydraulic drive unit 114.

The discharge valve 12 is a valve body arranged in such a manner as to open/close a drain port 10*a* and supplies flush water and stops the supply of flush water to the flush toilet main body 2. The discharge valve 12 is pulled up by a driving force of the discharge valve hydraulic drive unit 114, and upon the discharge valve 12 being pulled up to a predetermined pull-up height, the clutch mechanism 130 is disconnected and the discharge valve 12 descends because of its own weight. The discharge valve 12 is arranged inside the discharge valve casing 113. The discharge valve casing 113 covers the upper and outer peripheral sides of the discharge valve 12. The discharge valve casing 113 is formed in a cylindrical shape covering the upper side of the discharge valve 12. The discharge valve casing 113 is formed from a position in water below a full water level WL of flush water to a position in air above the full water level WL. The discharge valve casing 113 is fixed to a floor surface of a storage tank 10 in a base unit. The discharge valve casing 113 is not fixed to the discharge valve hydraulic drive unit 114 but is provided inside the storage tank 10 independently from the discharge valve hydraulic drive unit 114.

The discharge valve hydraulic drive unit 114 is configured to drive the discharge valve 12 by using water supply pressure of flush water supplied from a tap. More specifically, the discharge valve hydraulic drive unit 114 has a cylinder 14*a* into which water supplied from a first control valve 16 flows, a piston 14*b* slidably arranged in the cylinder 14*a*, and a discharge valve driving rod 132 that projects from an end of the cylinder 14*a* and that drives the discharge valve 12. The discharge valve hydraulic drive unit 114 is a horizontally-arranged discharge valve hydraulic drive unit that drives the piston 14*b* and the discharge valve driving rod 132 horizontally. The discharge valve hydraulic drive unit 114 is arranged so as to space out from the discharge valve casing 113, outside the discharge valve casing 113 with the discharge valve 12 arranged inside.

Furthermore, inside the cylinder 14*a*, a spring 14*c* is arranged and energizes the piston 14*b* laterally toward a first end portion 14*g* on the discharge valve 12 side. Also, packing 14*e* is attached to the piston 14*b*, ensuring water tightness of a part between an inner wall surface of the cylinder 14*a* and the piston 14*b*. Furthermore, the clutch mechanism 130 is provided at the other end of the discharge valve driving rod 132, and the discharge valve driving rod 132 and a connecting member 170 connected to a valve stem 12*a* of the discharge valve 12 are coupled/decoupled by the clutch mechanism 130.

The cylinder 14*a* is a cylindrical member and is arranged in such a manner that an axis thereof extends transversely, for example, horizontally, and receives the piston 14*b* inside in such a manner that the piston 14*b* is slidable horizontally. Also, a drive unit water supply passage 34*a* is connected to the first end portion 14*g* on the discharge valve 12 side of the cylinder 14*a*, and flush water flowing out from the first control valve 16 flows into the cylinder 14*a*. Therefore, the piston 14*b* inside the cylinder 14*a* is driven horizontally from the first end portion 14*g* toward a second end portion 14*h* against energizing force of the spring 14*c*, by flush water flowing into the cylinder 14*a*.

On the other hand, an outflow hole is provided at a lower portion of the cylinder 14*a*, and a drive unit discharge passage 34*b* communicates with the inside of the cylinder 14*a* via the outflow hole. Therefore, upon flush water flowing into the cylinder 14*a* from the drive unit water supply passage 34*a* connected to the cylinder 14*a*, the piston 14*b* is pushed ahead from the first end portion 14*g*-side part of the cylinder 14*a*, which is a first position, toward the second end portion 14*h*. The piston 14*b* is driven by pressure of flush water flowing into the cylinder. Then, upon the piston 14*b* being pushed ahead to a second position on the second end portion 14*h* side relative to the outflow hole, water flowing into the cylinder 14*a* flows out from the outflow hole through the drive unit discharge passage 34*b*. In other words, upon the piston 14*b* moving to the second position, the drive unit water supply passage 34*a* and the drive unit discharge passage 34*b* come into communication with each other via the inside of the cylinder 14*a*. The drive unit discharge passage 34*b* extending from the cylinder 14*a* is configured to make water flow into the storage tank 10 and also make water flow into an overflow pipe 10*b*.

The discharge valve driving rod 132 is a rod-like member connected to a side surface on the discharge valve 12 side of the piston 14*b* and extends in such a manner as to project laterally from the inside of the cylinder 14*a* through a through-hole 14*f* formed in a side surface of the cylinder 14*a*. The discharge valve driving rod 132 is connected to the piston 14*b* inside the cylinder 14*a* and is also coupled to the clutch mechanism 130 outside the cylinder 14*a*. Also, a gap 14*d* is provided between the discharge valve driving rod 132 projecting from a side of the cylinder 14*a* and an inner wall of the through-hole 14*f* of the cylinder 14*a*, and a part of flush water flowing into the cylinder 14*a* flows out from the gap 14*d*. Water flowing out from the gap 14*d* flows into the storage tank 10. Note that the gap 14*d* is relatively narrow and provides large flow channel resistance, and thus, even in a state in which water flows out from the gap 14*d*, flush water flowing into the cylinder 14*a* from the drive unit water supply passage 34*a* increases pressure inside the cylinder

14*a*, and the piston 14*b* is pushed ahead toward the second end portion 14*h* against the energizing force of the spring 14*c*.

The first control valve 16 is configured to control water supply to the discharge valve hydraulic drive unit 114 based on operation of a solenoid valve 18 and controls supply of water/stop the supply of water to the storage tank 10 via the drive unit discharge passage 34*b*.

A float switch 42 is arranged inside the storage tank 10 and is configured to, when a water level in the storage tank 10 rises to a full water level WL, stop water supply from the first control valve 16 to the discharge valve hydraulic drive unit 114.

A second control valve 22 is configured to control supply of water/stop the supply of water to a later-described adjustment mechanism 158 based on operation of a solenoid valve 24.

Next, a configuration and operation of the clutch mechanism 130 will be described with reference to FIG. 16, etc.

The clutch mechanism 130 in the second embodiment has a structure and a principle of operation that are substantially the same as those of the clutch mechanism 30 in the first embodiment. The clutch mechanism 130 in the second embodiment is different from the clutch mechanism 30 in the first embodiment in that the clutch mechanism 130 is a horizontal clutch mechanism provided horizontally at an end portion of the discharge valve driving rod 132 extending horizontally, while the clutch mechanism 30 is a vertical clutch mechanism provided vertically at an end portion of the discharge valve driving rod 32 extending vertically. The clutch mechanism 130 in the second embodiment has a structure that is substantially the same as that of the clutch mechanism 30 in the first embodiment except that the clutch mechanism 130 is attached horizontally and is moved horizontally, and thus description of parts that are in common will be omitted and different parts will mainly be described.

The clutch mechanism 130 is provided at an end portion of the discharge valve driving rod 132 extending laterally from the discharge valve hydraulic drive unit 114 and is configured to couple/decouple the end portion on the discharge valve side of the discharge valve driving rod 132 and an upper end of the connecting member 170. The clutch mechanism 130 is a horizontal clutch mechanism that is moved horizontally and horizontally couples/decouple the discharge valve driving rod 132 and a clutch mechanism connecting portion 172 aligned horizontally to/from each other. More specifically, the clutch mechanism 130 is formed to horizontally disengage the discharge valve driving rod 132 and the clutch mechanism connecting portion 172 from each other or horizontally engage the rod 132 and the clutch mechanism connecting portion 172 with each other via movement of a later-described hook member 130*b*. The clutch mechanism 130 is provided at a height that is substantially the same as that of the discharge valve driving rod 132.

The clutch mechanism 130 has a rotary shaft 130*a* attached to a lower end of the rod 132, a hook member 130*b* supported by the rotary shaft 130*a*, an engaging claw 30*c* provided at an end portion on the clutch mechanism side of the later-described clutch mechanism connecting portion 172, and a stop plate 130*f* that defines an upper limit of a pull-up position of a clutch mechanism 130. With such structure as above, the clutch mechanism 130 is disconnected at a predetermined timing and with a predetermined pull-up height (pull-up height of the discharge valve 12) to make the discharge valve 12 descend.

The hook member 130*b* extends in an inverted V-shape from the rotary shaft 130*a*. A discharge valve hydraulic drive unit-side part of the hook member 130*b*, which extends on the discharge valve hydraulic drive unit side relative to the rotary shaft 130*a*, forms a discharge valve hydraulic drive unit-side end portion 130*e* of the hook member 130*b*, and the discharge valve hydraulic drive unit-side end portion 130*e* of the hook member 130*b* is formed at a position and has a length, the position and length preventing the discharge valve hydraulic drive unit-side end portion 130*e* from coming into contact with a bottom surface of the discharge valve hydraulic drive unit 114 even in a state in which the piston 14*b* ascends most (pushed most ahead). A discharge valve-side part of the hook member 130*b*, which extends on the discharge valve side relative to the rotary shaft 130*a*, forms a hook portion 130*d* of the hook member 130*b*, the hook portion 130*d* extending obliquely upward as the inverted V-shape part and then being folded back toward the clutch mechanism connecting portion 172. The engaging claw 30*c* is a plate-like claw. Abase of the engaging claw 30*c* is formed vertically. The stop plate 130*f* is configured to, before the discharge valve hydraulic drive unit-side end portion 130*e* of the hook member 130*b* in a connected state comes into contact with the bottom surface of the discharge valve hydraulic drive unit 114, come into contact with the bottom surface of the discharge valve hydraulic drive unit 114 and stops pull-up of the discharge valve 12, etc.

In the state shown in FIG. 16, the discharge valve 12 is seated on the drain port 10*a* and the drain port 10*a* is closed. Also, in this state, the discharge valve hydraulic drive unit 114 and the discharge valve 12 are coupled, and in the coupled state, the hook portion 130*d* of the hook member 130*b* engages with the base of the engaging claw 30*c*, enabling the discharge valve 12 to be pulled up by the discharge valve driving rod 132.

The clutch mechanism 130 is arranged at a position on the discharge valve hydraulic drive unit 114 side between the discharge valve hydraulic drive unit 114 and the discharge valve casing 113 (or the discharge valve 12). For example, in a standby state, the clutch mechanism 130 is arranged at a position on the discharge valve hydraulic drive unit 114 side relative to a half of a total length of the discharge valve driving rod 132 and the connecting member 170 from the discharge valve hydraulic drive unit 114 to the discharge valve casing 113 (or the discharge valve 12). Note that the clutch mechanism 130 is arranged at a position on the discharge valve hydraulic drive unit 114 relative to an end portion on the discharge valve hydraulic drive unit side of a flexible member 174 formed by a wire. Furthermore, the clutch mechanism 130 is arranged at a position on the discharge valve hydraulic drive unit 114 side relative to the end portion on the discharge valve hydraulic drive unit side of the clutch mechanism connecting portion 172.

Since the clutch mechanism 130 is disposed at a position on the discharge valve hydraulic drive unit 114 side between the discharge valve hydraulic drive unit 114 and the discharge valve casing 113 (or the discharge valve 12), it is possible to enhance a degree of flexibility in setting a position at which the clutch mechanism 130 is disconnected, a degree of flexibility in position at which the clutch mechanism 130 is arranged and a degree of flexibility in structure of the clutch mechanism 130, in comparison with a case where the clutch mechanism 130 is arranged at a position on the discharge valve casing 113 side, which is close to the water surface. Also, it is possible to enhance a degree of flexibility in position at which an adjustment mechanism 158 that disconnects the clutch mechanism 130 is arranged and a degree of flexibility in structure of the adjustment mechanism 158. Also, a distance between the discharge valve hydraulic drive unit 114 and the clutch mechanism 130 in the standby state is shorter than a distance between the discharge valve casing 113 (or the discharge valve 12) and the clutch mechanism 130 in the standby state. Also, a difference in height between the discharge valve hydraulic drive unit 114 and the clutch mechanism 130 in the standby state is smaller than a difference in height between the discharge valve casing 113 (or the discharge valve 12) and the clutch mechanism 130 in the standby state.

The connecting member 170 connects the clutch mechanism 130 and the valve stem 12*a*. The connecting member 170 is longer than the discharge valve driving rod 132. The connecting member 170 is provided with the clutch mechanism connecting portion 172 connected to the clutch mechanism 130 and the flexible member 174 formed by a wire connecting the clutch mechanism connecting portion 172 and the valve stem 12*a*. The clutch mechanism connecting portion 172 extends on an axis that is the same as that of the discharge valve driving rod 132. The clutch mechanism connecting portion 172 is formed in the shape of a rod having rigidity. The clutch mechanism connecting portion 172 forms the engaging claw 30*c*.

The flexible member 174 is arranged inside a tube 176 extending from the discharge valve casing 113. The flexible member 174 can deform and conform to a shape of the tube 176. The flexible member 174 is arranged in such a manner as to curve along the shape of the curved tube 176. The flexible member 174 is configured in such a manner that, when one end portion is moved by a certain movement amount, the other end portion is moved by a certain movement amount likewise. In this way, the flexible member 174 transmits a pull-up motion from the one end portion or a pull-down motion from the other end portion as a motion of pulling up the other end portion or a motion of pulling down the one end portion. The flexible member 174 can connect the discharge valve hydraulic drive unit 114 and the discharge valve 12 regardless of the positions at which the discharge valve hydraulic drive unit 114 and the discharge valve 12 are arranged, and can transmit a pull-up motion and the like. Consequently, it is possible to more flexibly determine the positions at which the discharge valve hydraulic drive unit 114 and the discharge valve 12 are arranged. The flexible member 174 may be formed by any of other connecting members such as a chain and a bead chain.

A first float device 26 and a second float device 28 in the second embodiment are the same as the first float device 26 and the second float device 28 in the first embodiment, and thus, structures, operations, etc., thereof should be referred to, e.g., FIGS. 2 and 4 and description thereof will be omitted.

Next, the adjustment mechanism of the flush water tank apparatus will be described with reference to FIG. 16.

The flush water tank apparatus 104 is further provided with the adjustment mechanism 158 that adjusts a pull-up height of the discharge valve 12 with which the clutch mechanism 130 is disconnected. The adjustment mechanism 158 in the second embodiment are different in position of arrangement from the adjustment mechanism 58 in the first embodiment. However, the structure and principle of operation of the adjustment mechanism 158 in the second embodiment are substantially the same as those of the adjustment mechanism 58 in the first embodiment, and thus description thereof will be omitted.

The adjustment mechanism 158 is configured so that when a second amount of flush water is selected by a remote controller 6, the clutch mechanism 130 is disconnected at a pull-up height of the discharge valve 12 such that the discharge valve 12 descended by the disconnection of the clutch mechanism 130 is held by the second float device 28 in a holding state. As shown in FIG. 4B, the adjustment mechanism 158 is configured so that when the second amount of flush water is selected by the remote controller 6, the clutch mechanism 130 is disconnected when a holding claw 12*b* and a holding claw 12*c*, which are respective engaging portions of the discharge valve 12 for the first float device 26 and the second float device 28, are located at a height position between a first height position L1 and a second height position L2.

The adjustment mechanism 158 is provided with a cylinder portion 160 forming a piston cylinder that slides a piston vertically, a pressure chamber 158*a* into which water supplied from a water supply passage 50 flows, an elastic film 158*b*, which is a drive portion to be driven by water supply pressure of water flowing into the pressure chamber 158*a*, a rod member 162 that is driven by the elastic film 158*b* to make operational force act on the clutch mechanism 130 and that extends vertically from the cylinder portion 160 and that is vertically movable, and a spring 164 hat is arranged inside the cylinder portion 160 and that energizes the rod member 162 into the standby state via repulsive force. The cylinder portion 160, the pressure chamber 158*a*, the elastic film 158*b*, the rod member 162 and the spring 164 are similar in structure to the cylinder portion 60, the pressure chamber 58*a*, the elastic film 58*b*, the rod member 62 and the spring 64 in the first embodiment, respectively, except the direction of the arrangement, and thus, description similar to those of the first embodiment will be omitted. The adjustment mechanism 158 forms a vertical adjustment mechanism in which the rod member 162 is vertically driven. The adjustment mechanism 158 has a function that adjusts a position at which the clutch mechanism 130 is disconnected. For example, the adjustment mechanism 158 has a function that makes a T-shape part of the rod member 162 stop movement of an upper end of the hook member 130*b* and rotate the hook member 130*b*. Also, the adjustment mechanism 158 has a function that when the rod member 162 is in a raised state such as the standby state, makes the hook member 130*b* move in such a manner that the hook member 130*b* passes under the rod member 162, and makes the bottom surface of the discharge valve hydraulic drive unit 14 stop the movement of the upper end of the hook member 30*b* and rotate the hook member 30*b*.

The cylinder portion 160 is arranged at a position above the discharge valve hydraulic drive unit 114 and also above the discharge valve driving rod 132.

A volume of the pressure chamber 158*a* is smaller volume than a volume of the cylinder 14*a* of the discharge valve hydraulic drive unit 114. Consequently, the rod member 162 can be driven merely by a small amount of tap water being supplied to the pressure chamber 158*a*, enabling enhancement in responsiveness of the adjustment mechanism 158.

Also, an outflow hole (not shown) is provided in a lower portion of the pressure chamber 158*a*, and water flowing into the pressure chamber 158*a* flows out from the outflow hole to the storage tank 10. This outflow hole is relatively narrow and provides large flow channel resistance, and thus, even in a state in which water flows out from the outflow hole, pressure inside the pressure chamber 158*a* increases because of water flowing in from the second control valve 22.

The elastic film 158*b* is formed by, e.g., a diaphragm and is configured to drive the rod member 162 by elastically deforming based on water supply pressure of water flowing into the pressure chamber 158*a*. Consequently, in comparison with a case where the rod member 162 is driven by making the piston slide inside the pressure chamber 158*a*, there is no need to provide a slide seal for a piston, enabling elimination of a sliding resistance of a piston.

The rod member 162 includes a proximal end connected to the elastic film 158*b* and a distal end extending vertically toward the clutch mechanism 130. The rod member 162 is configured to move vertically toward the discharge valve driving rod 132 on the upper side relative to the discharge valve driving rod 132. The rod member 162 has the proximal end attached to the elastic film 158*b* and projects vertically toward the clutch mechanism 130 from a housing forming the pressure chamber 158*a*; however, there is no need to provide a shaft seal between the housing forming the pressure chamber 158*a* and a shaft rod of the rod member 162. Consequently, it is possible to eliminate sliding resistance due to a shaft seal between the housing of the pressure chamber 158*a* and the rod member 162.

As a result of the elastic film 158*b* deforming because of an increase in pressure inside the pressure chamber 158*a*, the rod member 162 projects toward the clutch mechanism 130. Then, when the inflow of water from the second control valve 22 ceases, the pressure inside the pressure chamber 158*a* is decreased by an outflow of water from the outflow hole. The decrease in pressure inside the pressure chamber 158*a* makes the deformed elastic film 158*b* return to its original shape, and the rod member 162 moves toward the pressure chamber 158*a*. Then, as described later, engagement between the valve stem 12*a* of the discharge valve 12 and the discharge valve driving rod 132 via the clutch mechanism 130 is released at the early timing by making the rod member 162 project toward the clutch mechanism 130, which is a discharge valve holding mechanism. Also, the vertical direction in which the rod member 162 projects intersects with a horizontal direction in which the discharge valve driving rod 132 is pulled up. Consequently, engagement between the discharge valve driving rod 132 and the valve stem 12*a* of the discharge valve 12 via the clutch mechanism 130 can reliably be released.

The rod member 162 includes a distal end formed in a T-shape and a first end 62*a* of the T-shape is arranged in the vicinity of the first end portion 14*g* of the discharge valve hydraulic drive unit 114. A second end 62*b* of the T-shape is provided on the clutch mechanism 130 side. The clutch mechanism 130 is disconnected by contacting the rod member 162 of the adjustment mechanism 158 with the clutch mechanism 130. More specifically the T-shape part of the rod member 162 is formed in a flat plate-like shape extending horizontally, and the clutch mechanism 130 can be disconnected at the early timing by the upper end of the hook member 130*b* of the clutch mechanism 130 hitting the second end 62*b* of the T-shape. When the clutch mechanism 130 hits the second end 62*b*, the first end 62*a* comes into contact with the bottom surface of the discharge valve hydraulic drive unit 114. Therefore, the rod member 162 can stably disconnect the clutch mechanism 130 when the clutch mechanism 130 hits the second end 62*b*. Also, a moving direction D1 in which the rod member 162 moves (direction perpendicular to the discharge valve driving rod 132) and a parting direction D2 in which the clutch mechanism 130 is disconnected and moves away (direction parallel to the discharge valve driving rod 132) are different from each other and form an angle of substantially 90 degrees.

The spring 164 is arranged on the T-shape part side of the inside of the cylinder portion 160 and moves the rod member 162 to the inner side of the cylinder portion 160 (retracts the rod member 162 to the cylinder portion 160 side) upon a decrease in supply of flush water into the cylinder portion 160.

Note that the adjustment mechanism 158 is not limited to a water supply-type adjustment mechanism in which, e.g., the rod member 162 is driven by flush water supplied to the cylinder portion 160 such as described above but may be an electric drive adjustment mechanism in which the rod member 162 is electrically driven by a drive portion with no cylinder portion 160 provided. In this case, a timing for driving the electric drive adjustment mechanism is controlled so that the below-described operation of the flush water tank apparatus 104 is provided by a controller 40.

Next, a description will be made on operation of the flush water tank apparatus 104 according to the second embodiment of the present invention and operation of a flush toilet apparatus 1 provided with the flush water tank apparatus 104 with reference to FIG. 16.

First, in the toilet washing standby state shown in FIG. 16, the water level in the storage tank 10 is the predetermined full water level WL. In this state, both of the first control valve 16 and the second control valve 22 are closed. Also, a first holding mechanism 46 and a second holding mechanism 48 are in the respective holding states indicated by the solid lines in FIG. 4A. Here, operation of the flush water tank apparatus 104 according to the second embodiment and the flush toilet apparatus 1 including the flush water tank apparatus 104 are basically similar to the flush water tank apparatus 4 according to the first embodiment and the flush toilet apparatus 1, and thus, description similar to that of the first embodiment will be omitted and operation of parts different from those of the first embodiment will be described.

Next, operation in a large washing mode will be described with reference to FIG. 16.

When an instruction signal to perform large washing is received, the controller 40 actuates the solenoid valve 18 included in the first control valve 16 to make a pilot valve 16*d* on the solenoid valve side leave from a pilot valve port. When the first control valve 16 is opened, flush water flowing in from a water supply pipe 38 is supplied to the discharge valve hydraulic drive unit 114 via the first control valve 16. Consequently, the piston 14*b* in the discharge valve hydraulic drive unit 114 is pushed up, the connecting member 170 is pulled up via the discharge valve driving rod 132, and flush water in the storage tank 10 is discharged from the drain port 10*a* to the flush toilet main body 2.

Furthermore, when the discharge valve 12 is pulled up, the clutch mechanism 130 is moved horizontally toward the discharge valve hydraulic drive unit 114 and the clutch mechanism 130 is thereby disconnected. In other words, when the discharge valve 12 reaches a predetermined height, an end of the hook member 130*b* of the clutch mechanism 130 is moved horizontally and thereby hits the bottom surface of the discharge valve hydraulic drive unit 114, which makes the hook member 130*b* rotate, whereby the clutch mechanism 130 is disconnected (see, e.g., FIGS. 3B to 3C). At this time, the holding claw 12*b* of the discharge valve 12 is pulled up to a position that is higher than an engaging member 46*c* of the first holding mechanism 46.

When the clutch mechanism 130 is disconnected, the discharge valve 12 starts descending toward the drain port 10*a* because of its own weight. The holding claw 12*b* of the descending discharge valve 12 engages with the engaging member 46*c* of the first holding mechanism 46, and the discharge valve 12 is kept at a predetermined height by the first holding mechanism 46. As a result of the discharge valve 12 being held by the first holding mechanism 46, the drain port 10*a* is kept open and discharge of flush water in the storage tank 10 to the flush toilet main body 2 is kept. Subsequently, in the second embodiment, also, as in the first embodiment, the discharge valve 12 descends again, and furthermore, the clutch mechanism 130 is connected (FIGS. 3E to 3H, etc.) and returns to the standby state before start of toilet washing.

Next, operation in a small washing mode will be described with reference to FIG. 16.

A standby state for toilet washing is similar to that in the large washing mode. When receiving an instruction signal to perform small washing, the controller 40 causes the solenoid valve 18 provided for the first control valve 16 to operate to open the first control valve 16. On the other hand, the controller 40 actuates the solenoid valve 24 included in the second control valve 22 to open a pilot valve 22*c* and thereby supply flush water to the water supply passage 50 extending from the second control valve 22. Therefore, flush water is supplied from the water supply passage 50 to the adjustment mechanism 158.

When the first control valve 16 is opened, flush water flowing in from the water supply pipe 38 is supplied to the discharge valve hydraulic drive unit 114 via the first control valve 16. Consequently, the piston 114*b* in the discharge valve hydraulic drive unit 114 is pushed up (moved horizontally), the connecting member 170 is pulled up via the discharge valve driving rod 132 and the discharge valve 12 is thereby pulled up, whereby flush water in the storage tank 10 is discharged from the drain port 10*a* to the flush toilet main body 2.

In the adjustment mechanism 158, as flush water is supplied from the water supply passage 50 into the cylinder portion 160, the rod member 162 is moved downward in the vertical direction toward the discharge valve driving rod 132 by the water pressure. The T-shape part of the rod member 162 is arranged on the forward side in a direction of movement of the clutch mechanism 130. The rod member 162 of the adjustment mechanism 158 is moved to a disconnection position at which the clutch mechanism 130 is disconnected, before reaching a pull-up position at which the clutch mechanism 130 is disconnected by the bottom surface of the discharge valve hydraulic drive unit 114 (pull-up height of the discharge valve 12). Therefore, the distal end of the hook member 130*b* of the clutch mechanism 130 horizontally moving hits the second end 62*b* of the T-shape and the hook member 30*b* is thereby rotated, whereby the clutch mechanism 30 is disconnected. The rod member 162 remains at the disconnection position at which the clutch mechanism 130 is disconnected, for a predetermined time even after reaching the disconnection position.

As shown in FIGS. 16 and 4B, when the second amount of flush water is selected by the remote controller 6, when each of the holding claw 12*b* and the holding claw 12*c* of the discharge valve 12 is located at a height position between the first height position L1 and the second height position L2, the clutch mechanism 130 is disconnected by the adjustment mechanism 158. When the clutch mechanism 130 is disconnected, the discharge valve 12 starts descending toward the drain port 10*a* because of its own weight. Here, in the second embodiment, also, as in the first embodiment, the holding claw 12*c* of the descending discharge valve 12 engages with the engaging member 48*c* of the second holding mechanism 48, and the discharge valve 12 is held at a predetermined height by the second holding mechanism 48 as shown in FIG. 12.

After a lapse of a time sufficient for the clutch mechanism 130 to be disconnected, the controller 40 transmits a signal to the solenoid valve 24 (FIG. 16) at a predetermined timing to close the second control valve 22. Consequently, the supply of flush water to the adjustment mechanism 158 is stopped. Therefore, the water pressure of flush water in the cylinder portion 160 decreases, and the rod member 162 is thus pulled back to the cylinder portion 160 side by the spring 164. The subsequent operation in the small washing mode in the second embodiment is substantially the same as that in the small washing mode in the first embodiment, and thus, description thereof will be omitted.

Furthermore, when the water level in the storage tank 10 rises to the predetermined full water level WL and water supply to the discharge valve hydraulic drive unit 114 is stopped, the piston 14*b* in the discharge valve hydraulic drive unit 114 is pushed down toward the first end portion 14*g* side, and accordingly, the discharge valve driving rod 132 is moved toward the discharge valve 12 side. Consequently, the clutch mechanism 130 is connected (FIGS. 3E to 3H) and returns to the standby state before the start of toilet washing (state in FIG. 16).

Although the second embodiment has been described above, the structure of the first embodiment, the structure of the second embodiment and the structures of the modifications can entirely or partly be changed through arbitrary recombination or extraction.

With the above-described flush water tank apparatus 104 according to the second embodiment of the present invention, the discharge valve hydraulic drive unit 114 is arranged so as to space out from the discharge valve casing 113, outside the discharge valve casing 113 which the discharge valve 12 arranged inside, and the clutch mechanism 130 is arranged at a position on the discharge valve hydraulic drive unit side between the discharge valve hydraulic drive unit 114 and the discharge valve casing 113. Thereby, the clutch mechanism 130 can be arranged at a position on the discharge valve hydraulic drive unit side between the discharge valve casing 113 and the discharge valve hydraulic drive unit 114, enabling enhancement in degree of flexibility in setting a position at which the clutch mechanism 130 is disconnected and degree of flexibility in position at which the clutch mechanism 130 is arranged.

REFERENCE SIGNS LIST

1 flush toilet apparatus
2 flush toilet main body
4 flush water tank apparatus
6 remote controller
10 storage tank
10*a* drain port
12 discharge valve
14 discharge valve hydraulic drive unit
26 first float device
26*a* first float
28 second float device
28*a* second float
30 clutch mechanism
32 rod
58 adjustment mechanism
62 rod member

What is claimed is:

1. A flush water tank apparatus for supplying flush water to a flush toilet, the flush water tank apparatus comprising:

a storage tank which stores flush water to be supplied to the flush toilet and in which a drain port for discharging the stored flush water to the flush toilet is formed;

a discharge valve that opens and closes the drain port and that supplies flush water and stops the supply of flush water to the flush toilet;

a discharge valve hydraulic drive unit that drives the discharge valve by using water supply pressure of supplied tap water;

a clutch mechanism that couples the discharge valve and the discharge valve hydraulic drive unit to pull up the discharge valve by a driving force of the discharge valve hydraulic drive unit and that is disconnected at a predetermined pull-up height of the discharge valve to make the discharge valve descend;

a flush water amount selection portion capable of selecting between a first amount of flush water for flushing the flush toilet and a second amount of flush water that is different from the first amount of flush water;

a first float device that is moved according to a water level in the storage tank, the first float device being configured to be switched according to the water level from a holding state in which descent of the discharge valve is prevented to a non-holding state in which the descent is not prevented so as to discharge the first amount of flush water;

a second float device that is moved according to the water level in the storage tank, the second float device being configured to be switched from a holding state in which descent of the discharge valve is prevented to a non-holding state in which the descent is not prevented, according to the water level so as to discharge the second amount of flush water; and an adjustment mechanism that adjusts the pull-up height of the discharge valve with which the clutch mechanism is disconnected, the adjustment mechanism being configured so that when the second amount of flush water is selected by the flush water amount selection portion the clutch mechanism is disconnected at a pull-up height of the discharge valve such that the discharge valve descended by the disconnection of the clutch mechanism is held by the second float device in the holding state.

2. The flush water tank apparatus according to claim 1, wherein:

the second amount of flush water is smaller than the first amount of flush water;

a first height position at which the first float device in the holding state engages with the discharge valve is higher than a second height position at which the second float device in the holding state engages with the discharge valve; and the adjustment mechanism is configured so that when the second amount of flush water is selected by the flush water amount selection portion and the clutch mechanism is disconnected when an engaging portion of the discharge valve for the first float device and the second float device is located at a height position between the first height position and the second height position.

3. The flush water tank apparatus according to claim 2, further comprising:

a discharge valve holding mechanism that includes the clutch mechanism and that provides with an engaging member preventing descent of the discharge valve due to weight of the discharge valve for a predetermined period of time by engaging with the discharge valve; and a valve control hydraulic drive unit that is operated based on water supply pressure of supplied tap water and is an adjustment mechanism controlling a timing when the discharge valve descends, wherein when the second amount of flush water is selected by the flush water amount selection portion, the valve control hydraulic drive unit applies operational force on the discharge valve holding mechanism and by driving the engaging member of the discharge valve holding mechanism the discharge valve is descended at an earlier timing in comparison with a case where the first amount of flush water is selected.

4. The flush water tank apparatus according to claim 3, wherein:

the discharge valve hydraulic drive unit comprises a cylinder into which tap water flows, a piston that is arranged inside the cylinder and that slides by water supply pressure of the tap water flowing into the cylinder, and a discharge valve driving rod that is connected to the piston, that projects and extends from a through-hole formed in the cylinder and that is coupled to the discharge valve to drive the discharge valve;

the valve control hydraulic drive unit comprises a pressure chamber into which tap water flows, a drive portion to be driven by water supply pressure of the tap water flowing into the pressure chamber, and a rod member that is driven by the drive portion and that applies operational force act on the discharge valve holding mechanism; and a volume of the pressure chamber is smaller volume than a volume of the cylinder.

5. The flush water tank apparatus according to claim 4, wherein the valve control hydraulic drive unit makes the rod member project toward the discharge valve holding mechanism based on the water supply pressure of the tap water flowing into the pressure chamber.

6. The flush water tank apparatus according to claim 5, wherein the drive portion of the valve control hydraulic drive unit includes an elastic film coupled to the rod member and deformed by the water supply pressure of the tap water flowing into the pressure chamber, and the rod member is made to project by the deformation of the elastic film.

7. The flush water tank apparatus according to claim 4, wherein the rod member of the valve control hydraulic drive unit is made to project toward the discharge valve holding mechanism by the water supply pressure of the tap water flowing into the pressure chamber, and a direction of the projection intersects with a direction in which the discharge valve is pulled up.

8. The flush water tank apparatus according to claim 4, wherein the rod member of the valve control hydraulic drive unit is made to project toward the clutch mechanism by the water supply pressure of the tap water flowing into the pressure chamber, and after the rod member projects maximally, the rod member contacts with the engaging member of the clutch mechanism, a connection between the discharge valve and the discharge valve hydraulic drive unit is disconnected.

9. The flush water tank apparatus according to claim 4, wherein tap water is supplied to the valve control hydraulic drive unit simultaneously with a supply to the discharge valve hydraulic drive unit or earlier than a supply to the discharge valve hydraulic drive unit.

10. The flush water tank apparatus according to claim 1, wherein:

the adjustment mechanism comprises a movable rod member; and the clutch mechanism is disconnected by contacting the rod member of the adjustment mechanism with the clutch mechanism.

11. The flush water tank apparatus according to claim 10, wherein a moving direction in which the rod member of the adjustment mechanism moves and a parting direction in which the clutch mechanism is disconnected and moves away are different from each other.

12. The flush water tank apparatus according to claim 10, wherein the rod member of the adjustment mechanism is moved to a disconnection position at which the clutch mechanism is disconnected, before the discharge valve reaches the pull-up height at which the clutch mechanism is disconnected.

13. The flush water tank apparatus according to claim 12, wherein the rod member of the adjustment mechanism remains at the disconnection position for a predetermined time, even after the discharge valve reaches the pull-up height at which the clutch mechanism is disconnected.

14. The flush water tank apparatus according to claim 10, wherein the adjustment mechanism is configured to move the rod member by supplied flush water.

15. The flush water tank apparatus according to claim 1, wherein the discharge valve hydraulic drive unit is arranged so as to space out from a discharge valve casing with the discharge valve arranged inside, outside the discharge valve casing, and the clutch mechanism is arranged at a position on a discharge valve hydraulic drive unit side between the discharge valve hydraulic drive unit and the discharge valve casing.

16. A flush toilet apparatus having a plurality of washing modes that are different in an amount of flush water, the flush toilet apparatus comprising:

a flush toilet; and the flush water tank apparatus according to claim 1, the flush water tank apparatus supplying flush water to the flush toilet.

* * * * *